US009382091B2

(12) United States Patent
Masuyama

(10) Patent No.: US 9,382,091 B2
(45) Date of Patent: Jul. 5, 2016

(54) SHEET PROCESSING APPARATUS, CONTROL METHOD THEREFOR, AND STORAGE MEDIUM

(71) Applicant: CANON KABUSHIKI KAISHA, Tokyo (JP)

(72) Inventor: Yuka Masuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/095,254

(22) Filed: Dec. 3, 2013

(65) Prior Publication Data

US 2014/0159304 A1 Jun. 12, 2014

(30) Foreign Application Priority Data

Dec. 7, 2012 (JP) ..... 2012-268805

(51) Int. Cl.
*B65H 31/34* (2006.01)
*G03G 15/00* (2006.01)

(52) U.S. Cl.
CPC ..... *B65H 31/34* (2013.01); *G03G 15/6552* (2013.01); *B65H 2511/414* (2013.01); *B65H 2511/415* (2013.01); *B65H 2513/514* (2013.01); *B65H 2601/521* (2013.01)

(58) Field of Classification Search
CPC ..... B65H 31/34; B65H 2511/414; B65H 2511/415; B65H 2601/521; B65H 2513/514; G03G 15/6552
USPC ..... 271/221, 222, 226, 227, 240
See application file for complete search history.

(56) References Cited

U.S. PATENT DOCUMENTS

| | | | | |
|---|---|---|---|---|
| 7,195,238 | B2 * | 3/2007 | Suga et al. | 271/228 |
| 7,942,407 | B2 | 5/2011 | Someya et al. | |
| 7,986,912 | B2 * | 7/2011 | Maruyama | 399/394 |
| 8,240,664 | B2 * | 8/2012 | Sekigawa | 271/220 |
| 2006/0244200 | A1 | 11/2006 | Someya et al. | |
| 2008/0187383 | A1 | 8/2008 | Yamamoto | |
| 2009/0129893 | A1 * | 5/2009 | Masuyama | 412/13 |
| 2009/0243198 | A1 * | 10/2009 | Konishi | 271/221 |
| 2009/0315243 | A1 | 12/2009 | Watanabe et al. | |
| 2011/0115152 | A1 | 5/2011 | Sugizaki | |
| 2012/0260606 | A1 * | 10/2012 | Noguchi et al. | 53/255 |
| 2013/0292898 | A1 * | 11/2013 | Miyamoto et al. | 271/227 |

FOREIGN PATENT DOCUMENTS

| | | | |
|---|---|---|---|
| CN | 1854046 | A | 11/2006 |
| CN | 101609275 | A | 12/2009 |
| DE | 3710329 | A1 | 1/1988 |
| JP | 2006-206331 | A | 8/2006 |

OTHER PUBLICATIONS

Sep. 14, 2015 Chinese Office Action in Chinese Patent Appln. No. 201310655785.1.

* cited by examiner

*Primary Examiner* — Patrick Cicchino
(74) *Attorney, Agent, or Firm* — Fitzpatrick, Cella, Harper & Scinto

(57) ABSTRACT

The present sheet processing apparatus determines whether or not a received job includes a setting for executing an alignment process, and if the alignment process is set to be executed, performs control to execute the alignment process.

10 Claims, 18 Drawing Sheets

POSITIONS OF ALIGNMENT PLATES WHEN ALIGNMENT IS FINISHED

POSITIONS OF ALIGNMENT PLATES THAT HAVE BEEN RAISED OFF TRAY

POSITIONS OF ALIGNMENT PLATES FOR ACCEPTING NEXT SHEET

POSITIONS OF ALIGNMENT PLATES COMING INTO CONTACT WITH ALREADY-STACKED SHEETS

POSITIONS OF ALIGNMENT PLATES WHEN SHEET IS DISCHARGED

POSITIONS OF ALIGNMENT PLATES WHEN EXECUTING ALIGNMENT

ALIGNMENT WAITING POSITIONS OF ALIGNMENT PLATES

| CATEGORY | SETTINGS FOR WHICH ALIGNMENT PROCESS IS SET TO OFF |
|---|---|
| JOB SETTING | SAMPLE PRINTING |
| | RUSH PRINTING |
| MEDIUM TYPE | INCLUDE THIN PAPER |
| | INCLUDE COATED PAPER |
| | OHP SHEET |
| IMAGE FORMING APPARATUS | SILENT MODE IS SET TO ON |

SHEET PROCESSING APPARATUS, CONTROL METHOD THEREFOR, AND STORAGE MEDIUM

BACKGROUND OF THE INVENTION

1. Field of the Invention

The present invention relates to a sheet processing apparatus, a control method therefor, and a storage medium.

2. Description of the Related Art

For sheet processing apparatuses that stack a large number of sheets, there has been demand for the ability to discharge and align the sheets with a high degree of accuracy. Japanese Patent Laid-Open No. 2006-206331 suggests a sheet alignment process in which alignment members are provided on a stack tray, and sheets are piled up in such a manner that the positions of edge surfaces of the sheets parallel to a sheet discharge direction are aligned by the alignment members coming into and out of contact with the edge surfaces of the sheets.

However, the above conventional technique has the following problems. For example, although the above conventional technique places emphasis on the alignment performance and applies the alignment process at the time of discharge, there are cases where it is not necessary to place emphasis on the alignment performance for output materials depending on the purpose of a user and the type of a job. For example, even when the user wants to check pages that are being output to a discharge destination in the middle of the output, constant operations of an alignment process unit do not allow the user to easily pick up the output materials in the middle of the output, unlike when pages are discharged to a sheet processing apparatus with no alignment process.

The types of jobs that do not place emphasis on the alignment performance compared to other types of jobs are, for example, rush printing (interrupt printing) and a sample printing job. According to these types of printing, there are cases where the stacking performance is not required because output materials are expected to be immediately picked up from a discharge tray. Furthermore, the alignment process may cause friction depending on the type of mediums used in certain jobs; therefore, in the case where the alignment process is not desirable for those jobs, it is required to perform control so as not to apply the alignment process only to those jobs.

However, according to the above conventional technique, whether or not to apply the alignment process on a per-job basis cannot be set, and therefore it is necessary for the user to pre-set a discharge tray on which the alignment process is not executed, or it is necessary to output sheets on the premise that the output sheets will be subject to the friction. Furthermore, in the alignment process, operational noise occurs while the alignment process unit is in operation. For example, in the case where the sheet processing apparatus is operating in a silent mode in which this operational noise is undesirable, it may be appreciated if the alignment process is not applied to give priority to silence. As described above, although there are cases where the alignment process is undesirable depending on the purpose, conventional configurations do not control the operations of the alignment process in accordance with the types or purposes of jobs.

SUMMARY OF THE INVENTION

The present invention enables realization of a mechanism for switching between application and non-application of alignment to discharged sheets on a per-job basis.

One aspect of the present invention provides a sheet processing apparatus comprising: an alignment unit configured to align sheets stacked on a sheet stack unit; a receiving unit configured to receive a job; a judgment unit configured to judge whether or not an alignment process is set to be executed by the alignment unit for the job received by the receiving unit; and a control unit configured to, in a case where the judgment unit has judged that the alignment process is set to be executed by the alignment unit, perform control such that the alignment process is executed.

Another aspect of the present invention provides a control method for a sheet processing apparatus that includes an alignment unit that aligns sheets stacked on a sheet stack unit, the control method comprising: receiving a job; judging whether or not an alignment process is set to be executed by the alignment unit for the received job; and performing control such that the alignment process is executed in a case where it has been judged that the alignment process is set to be executed by the alignment unit.

Still another aspect of the present invention provides a non-transitory computer-readable storage medium storing a computer program for causing a computer to execute the control method for the sheet processing apparatus.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<Overall Configuration>

Figure 1:
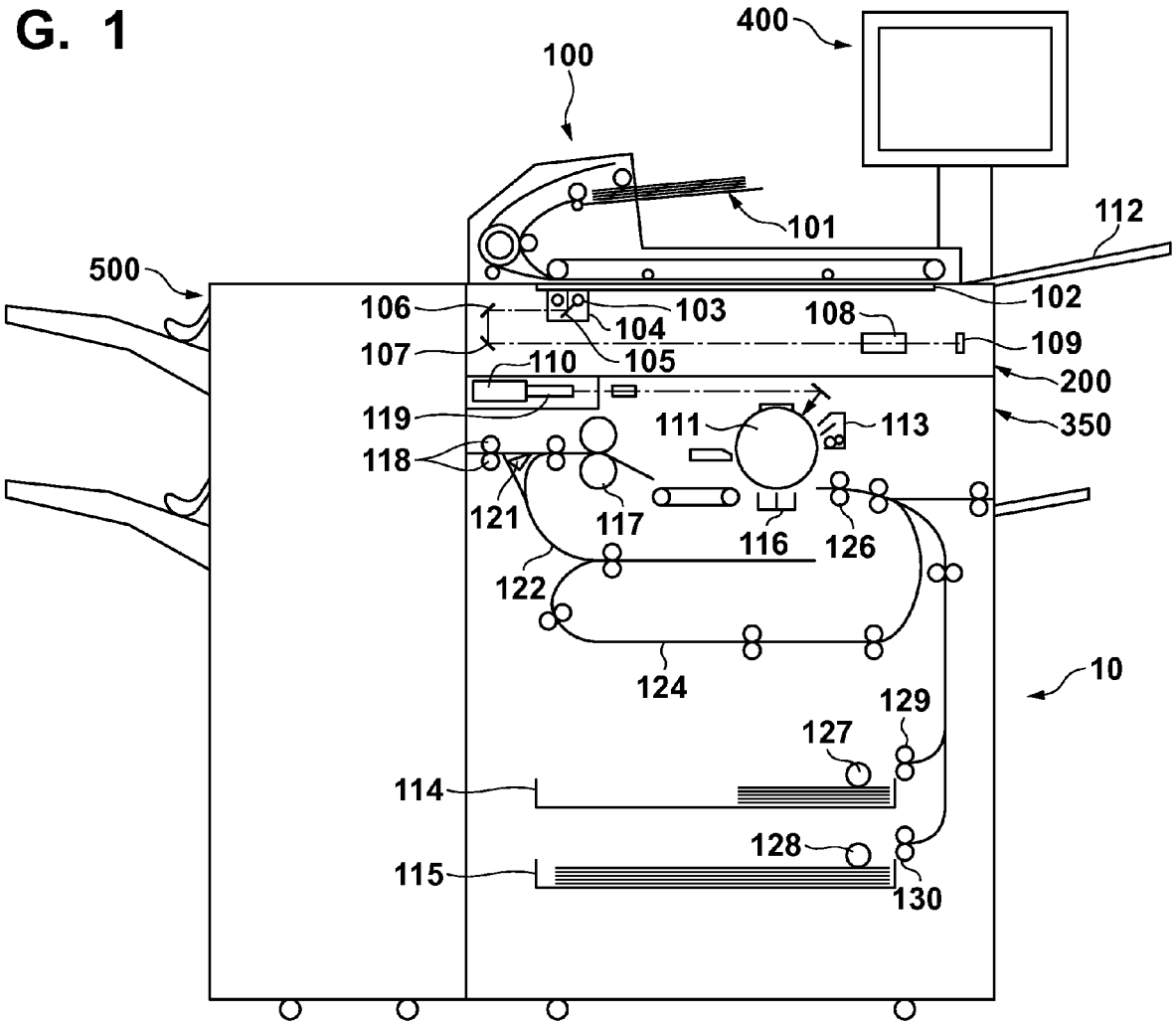
FIG. 1 is a configuration diagram showing cross-sectional configurations of main parts of an image forming system according to embodiments.

FIG. 1 is a configuration diagram showing a cross-sectional configuration of main parts of an image forming system according to embodiments of the present invention.

This image forming system includes an image forming apparatus 10 and a finisher 500 which serves as a sheet stacker. In the image forming system (sheet processing apparatus) described herein, the finisher 500 is connected to the image forming apparatus 10. It should be noted, however, that the present invention is not limited in this way, and is applicable to any sheet processing apparatus with a mechanism to discharge and stack sheets. That is to say, the image forming system, the image forming apparatus and the sheet stacker can each serve as an example of the sheet processing apparatus. The image forming apparatus 10 includes an image reader 200 that reads an image from an original, and a printer 350 that forms (prints) the read image on a sheet.

A document feeder 100 feeds originals set on an original tray 101 one by one in order starting from the top original, conveys the originals along a curved path and past a predetermined pickup position on a glass platen 102, then discharges the originals onto a discharge tray 112. Note that the originals are set on the original tray 101 with their front sides up. At this time, a scanner unit 104 is fixed at a predetermined reading position. When an original passes the reading position, an image of the original is read by the scanner unit 104. When the original passes the reading position, the original is irradiated with light from a lamp 103 in the scanner unit 104, and reflected light from the original is directed to a lens 108 via mirrors 105, 106 and 107. Light that has passed through this lens 108 is focused on an imaging surface of an image sensor 109, converted into image data, and output. The image data output from the image sensor 109 is input as a video signal to an exposure unit 110 in the printer 350.

The exposure unit 110 in the printer 350 outputs laser light that has been modulated based on a video signal input from the image reader 200. A photosensitive drum 111 is irradiated with and scanned by this laser light using a polygon mirror 119. An electrostatic latent image corresponding to the laser light that has scanned the photosensitive drum 111 is formed on the photosensitive drum 111. This electrostatic latent image on the photosensitive drum 111 turns into a visible image by being developed using the developer supplied from a developer 113.

Sheets used in the printing are picked up one by one from a sheet feeding tray 114 or 115, which is provided in the printer 350, by rotation of a pickup roller 127 or 128. The sheets thus picked up are conveyed to the position of registration rollers 126 by rotation of sheet feeding rollers 129 or 130. Although FIG. 1 shows only two sheet feeding trays for the sake of explanation, the printer 350 may include other sheet feeding trays that are not shown in the figures. Furthermore, additional sheet feeding trays may be provided by connecting an optional sheet feeding apparatus not shown in the figures to the printer 350. When the leading edge of a sheet arrives at the position of the registration rollers 126, the registration rollers 126 are driven and rotated at a predetermined timing so as to convey the sheet between the photosensitive drum 111 and a transfer unit 116. Accordingly, a developer image formed on the photosensitive drum 111 is transferred to the fed sheet by the transfer unit 116. The sheet to which the developer image has been thus transferred is conveyed to a fixing unit 117. The fixing unit 117 fixes the image on the sheet by applying heat and pressure to the sheet. The sheet that has passed the fixing unit 117 is discharged to the outside of the printer 350 (to the finisher 500) via a flapper 121 and discharge rollers 118. In the case where images are formed on both sides of the sheet, the sheet is conveyed to a double-sided conveying path 124 via a reversing path 122, then conveyed to the position of the registration rollers 126 again.

<Controller>

Figure 2:
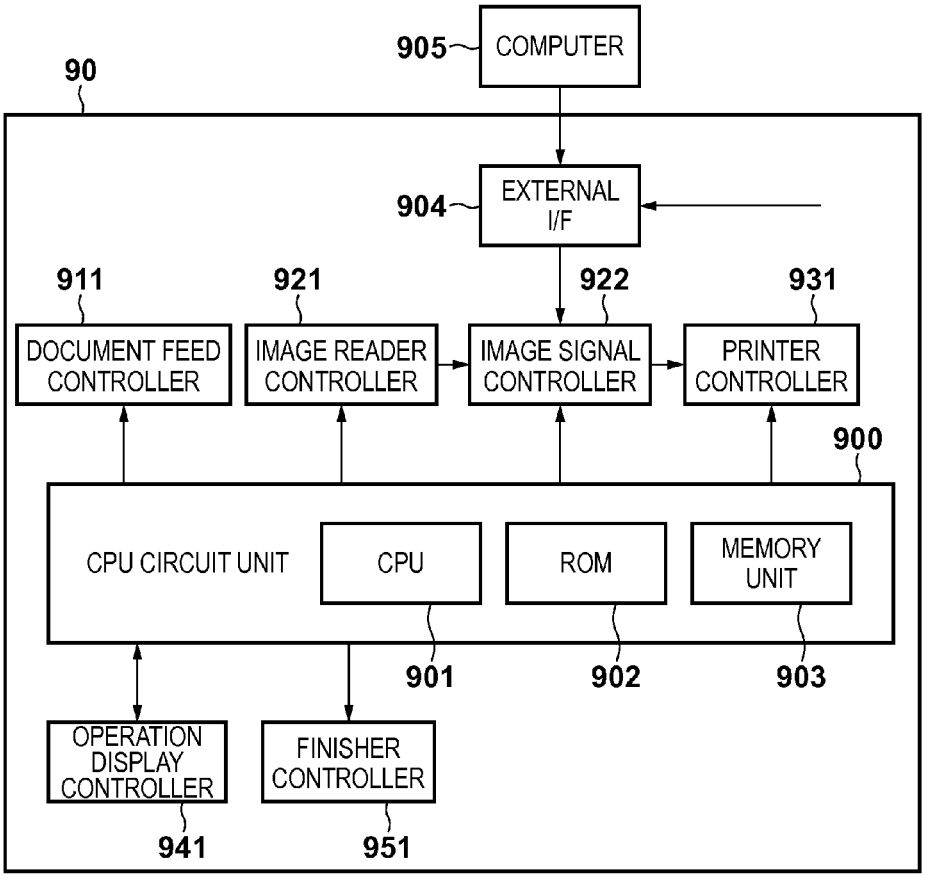
FIG. 2 is a block diagram showing a configuration of a controller that controls the entirety of the image forming system according to embodiments.

The following describes a configuration of a controller unit 90 that controls the entirety of the present image forming system with reference to FIG. 2.

As shown in FIG. 2, the controller unit 90 includes a CPU circuit unit 900 in which a CPU 901, a ROM 902 and a storage unit 903 are built. The storage unit 903 is constituted by an HDD or a RAM. The CPU 901 performs basic control of the entirety of the present image forming system, and is connected to the ROM 902 in which control programs are written and to the storage unit 903 used for processing via an address bus and a data bus. The CPU 901 also performs overall control of control units 911, 921, 922, 904, 931, 941 and 951 based on the control programs stored in the ROM 902. The storage unit 903 temporarily holds control data and is used as a working area for calculation processing associated with control.

A document feed control unit 911 controls driving of the document feeder 100 based on instructions from the CPU circuit unit 900. An image reader control unit 921 controls driving of the above-described scanner unit 104, image sensor 109, and the like, and transfers an image signal output from the image sensor 109 to an image signal control unit 922. The image signal control unit 922 converts an analog image signal from the image sensor 109 into a digital signal, applies various types of processing to the digital signal, converts the digital signal into a video signal, and outputs the video signal to a printer control unit 931. The image signal control unit 922 also converts a digital image signal input from a computer 905 via an external I/F 904 into a video signal by applying various types of processing to the digital image signal, and outputs the video signal to the printer control unit 931. The operations of processing executed by this image signal control unit 922 are controlled by the CPU circuit unit 900.

The printer control unit 931 controls the exposure unit 110 and the printer 350 based on an input video signal so as to form images and convey sheets. A finisher control unit 951 is mounted on the finisher 500, and controls driving of the entirety of the finisher 500 by exchanging information with the CPU circuit unit 900. The details of this control will be described later. An operation display control unit 941 exchanges information with an operation display unit 400 and the CPU circuit unit 900. The operation display unit 400 includes, for example, a plurality of keys for setting various types of functions related to image formation, and a display unit for displaying information showing the states of settings. The operation display control unit 941 outputs key signals corresponding to operations applied to the keys to the CPU circuit unit 900, and displays corresponding information on the operation display unit 400 based on signals from the CPU circuit unit 900.

<Operation Display Unit>

Figure 3:
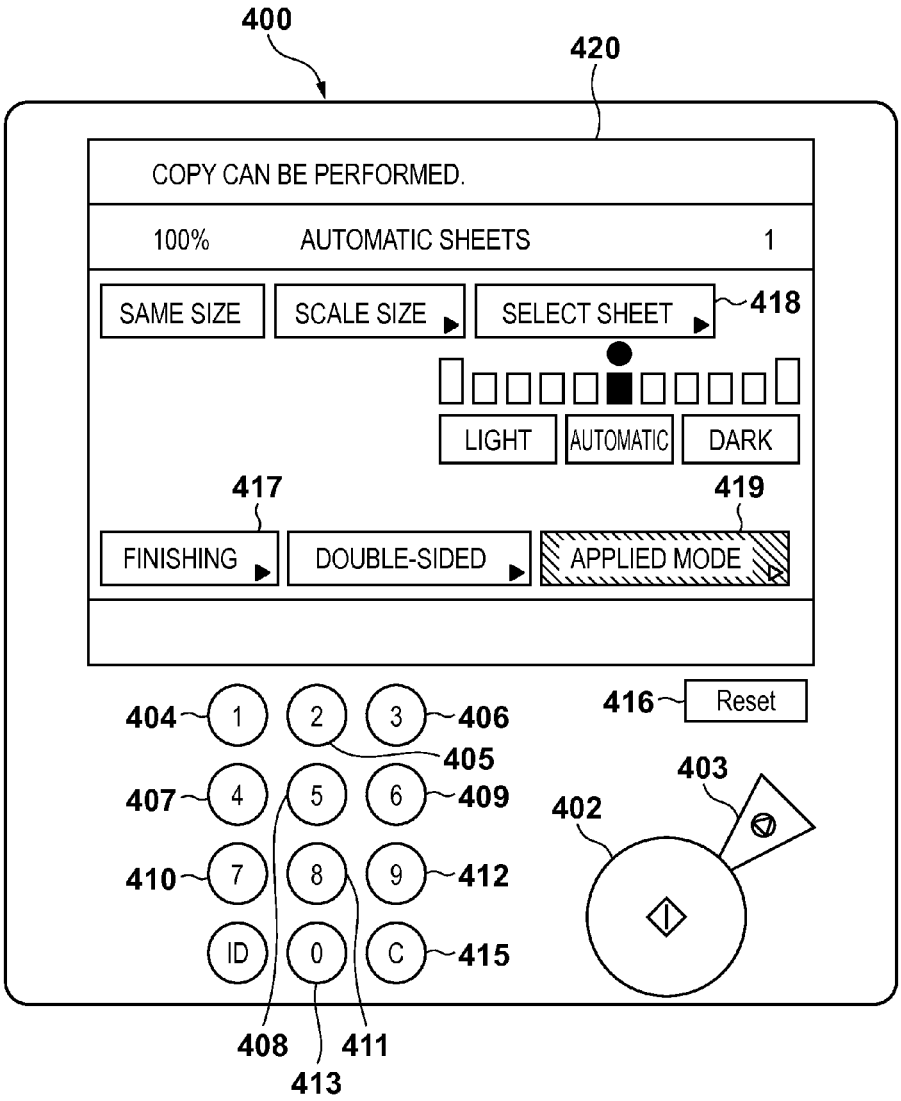
FIG. 3 is a diagram for describing an operation display unit 400 in an image forming apparatus according to embodiments.

FIG. 3 is a diagram for describing the operation display unit 400 in the image forming apparatus according to an embodiment.

For example, a start key 402 for starting the image forming operations, a stop key 403 for interrupting the image forming operations, numeric keys 404 to 413 for entering, for example, numbers, a clear key 415, and a reset key 416 are arranged on the operation display unit 400. A display unit 420 on the upper part of which a touch screen is formed is also arranged on the operation display unit 400, and software keys can be generated on a screen of the display unit 420.

This image forming apparatus includes various process modes as post-process modes, including no sort, sort, shift-sort, staple-sort (bind mode), and the like. The settings and the like for these process modes are input from the operation display unit 400. For example, a post-process mode is set as follows. When a "Finish" software key 417 is selected on a default screen shown in FIG. 3, a menu selection screen is displayed on the display unit 420. On this menu selection screen, a post-process mode is set.

<Finisher>

Figure 4B:
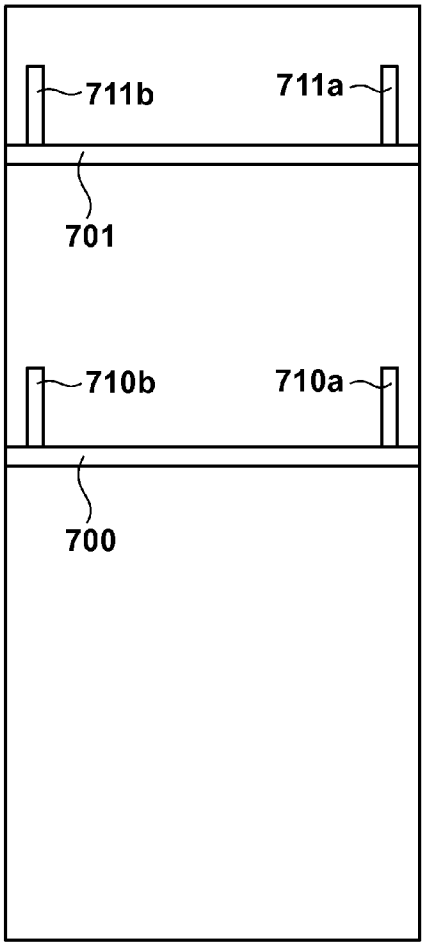
FIGS. 4A and 4B are diagrams for describing a configuration of a finisher according to embodiments, FIG. 4A showing the finisher as viewed from the front, and FIG. 4B showing the finisher as viewed in a direction opposing a sheet discharge direction.
Figure 4A:
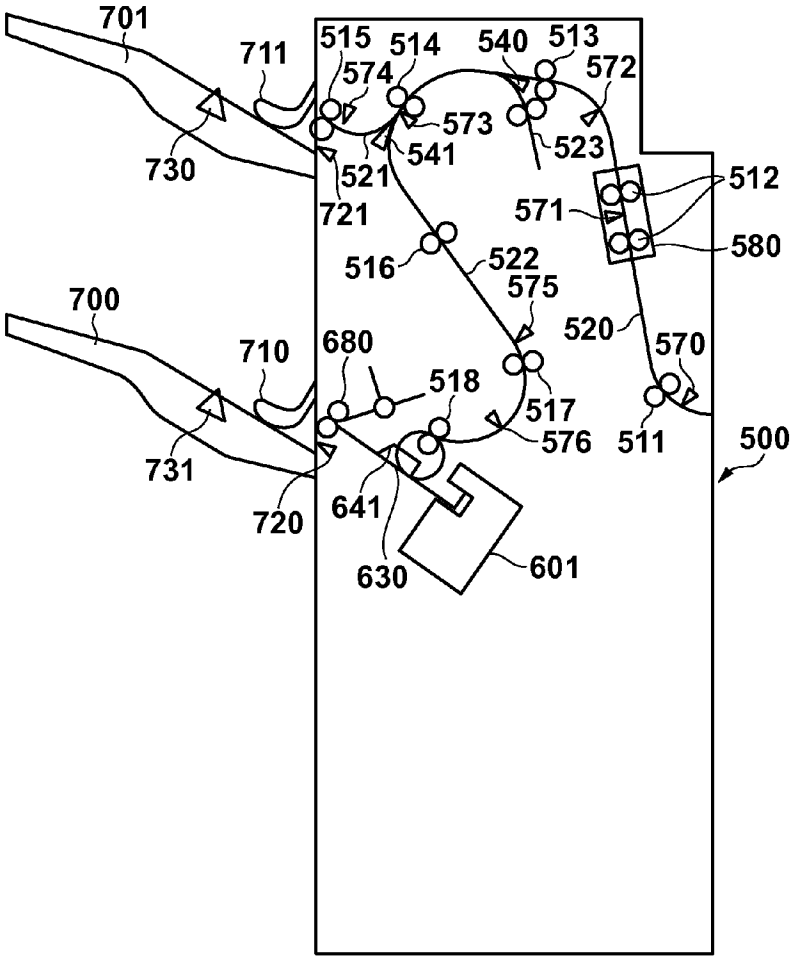

The following describes a configuration of the finisher 500 with reference to FIGS. 4A and 4B. FIGS. 4A and 4B are diagrams for describing a configuration of the finisher 500 according to embodiments of the present invention. FIG. 4A shows the finisher 500 as viewed from the front, and FIG. 4B shows stack trays 700 and 701 in the finisher 500 as viewed in a direction opposing a sheet discharge direction.

First, a description is provided with reference to FIG. 4A.

The finisher 500 receives sheets discharged from the image forming apparatus 10 in order, and executes post-processes such as a process for aligning the plurality of received sheets in a bundle, and a staple process for binding the trailing edges of the bundle of sheets using a stapler. The finisher 500 receives a sheet discharged from the image forming apparatus 10 along a conveyance path 520 using a pair of conveyance rollers 511. The sheet that has been received using the pair of conveyance rollers 511 is conveyed via pairs of conveyance rollers 512, 513 and 514. Conveyance sensors 570, 571, 572 and 573 are provided on the conveyance path 520 to detect passing of the sheet. The pair of conveyance rollers 512 is provided in a shift unit 580 together with the conveyance sensor 571.

Figure 5:
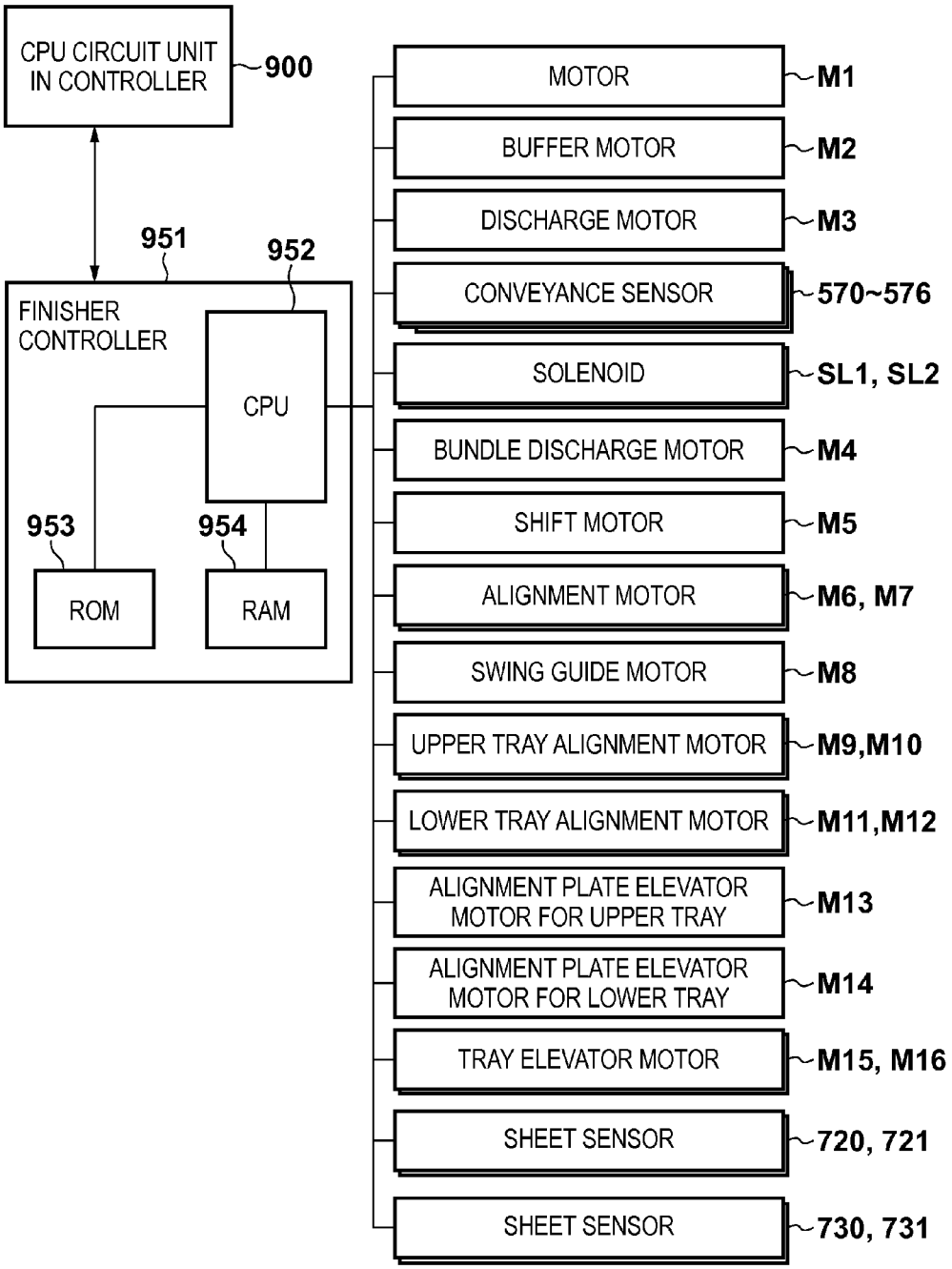
FIG. 5 is a block diagram showing a configuration of a finisher control unit according to embodiments.

The shift unit 580 can move the sheet in a sheet width direction orthogonal to a sheet conveyance direction using a later-described shift motor M5 (FIG. 5). By driving the shift motor M5 while the pair of conveyance rollers 512 is holding the sheet therebetween, the sheet can be offset in the width direction while being conveyed. In a shift-sort mode, the position of a bundle of sheets is moved in the width direction on a per-copy basis. For example, an offset value of 15 mm toward the front (front shift), or an offset value of 15 mm toward the back (back shift), is set with respect to the center position in the width direction. When no designation is made regarding the shift, sheets are discharged at the same position as in the front shift.

When the finisher 500 detects that a sheet has passed the shift unit 580 based on the input from the conveyance sensor 571, the finisher 500 drives the shift motor M5 (FIG. 5) to place the shift unit 580 back to the center position. A switching flapper 540, which directs a sheet conveyed in a reverse fashion by the pair of conveyance rollers 514 to a buffer path 523, is arranged between the pair of conveyance rollers 513 and the pair of conveyance rollers 514. The switching flapper 540 is driven by a later-described solenoid SL1 (FIG. 5).

A switching flapper 541, which switches between an upper discharge path 521 and a lower discharge path 522, is arranged between the pair of conveyance rollers 514 and the pair of conveyance rollers 515. The switching flapper 541 is driven by the later-described solenoid SL1. When the switching flapper 541 switches to the upper discharge path 521, a sheet is directed to the upper discharge path 521 by the pair of conveyance rollers 514 which is driven and rotated by a buffer motor M2 (FIG. 5). Then, the sheet is discharged onto the stack tray (discharge tray) 701 by the pair of conveyance rollers 515 which is driven and rotated by a discharge motor M3 (FIG. 5). A conveyance sensor 574 is provided on the upper discharge path 521 to detect passing of the sheet. When the switching flapper 541 switches to the lower discharge path 522, the sheet is directed to the lower discharge path 522 by the pair of conveyance rollers 514 which is driven and rotated by the buffer motor M2. This sheet is further directed to a process tray 630 by pairs of conveyance rollers 516 to 518 which are driven and rotated by the discharge motor M3. Conveyance sensors 575 and 576 are provided on the lower discharge path 522 to detect passing of the sheet. The sheet that has been directed to the process tray 630 is discharged onto the process tray 630 or the stack tray 700, in accordance with a post-process mode, by a pair of bundle discharge rollers 680 driven and rotated by a bundle discharge motor M4 (FIG. 5).

Figure 6A:
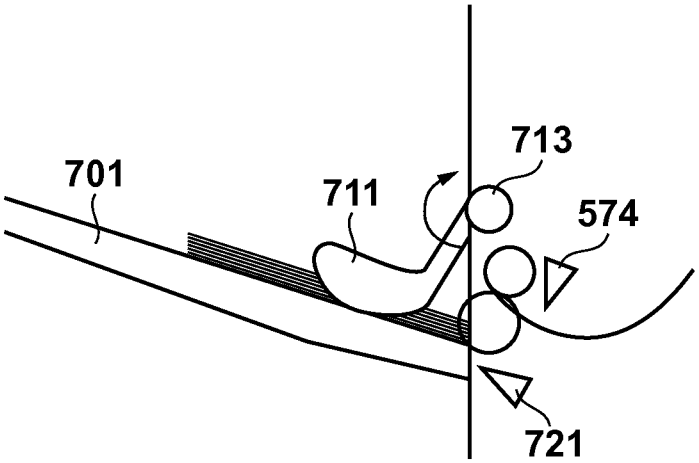
FIGS. 6A and 6B show a positional relationship between a receiving tray and alignment plates, FIG. 6A showing the state of the alignment plates when aligning sheets, and FIG. 6B showing the state where the alignment plates have been retracted.
Figure 6B:
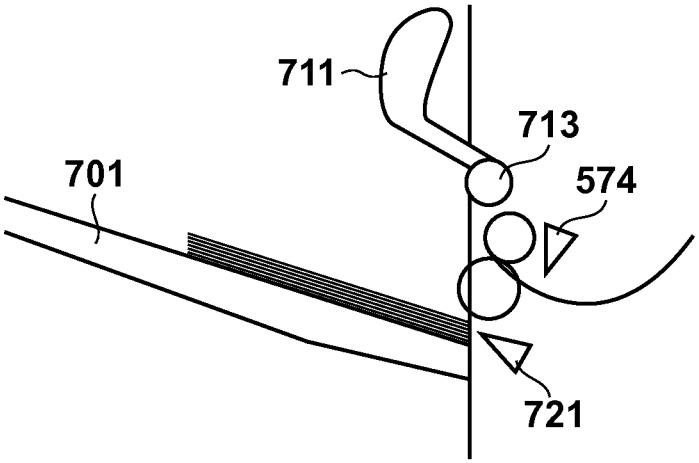

Furthermore, as shown in FIG. 4B, alignment plates 711*a* and 711*b* that are alignment members for aligning sheets discharged onto the stack tray 701 in the sheet width direction by coming into contact with both side edges (side surfaces parallel to the sheet conveyance direction) of the sheets are arranged on the stack tray 701. The alignment plate 711*a* is also referred to as a first alignment member and the alignment plate 711*b* is also referred to as a second alignment member. These alignment plates 711*a* and 711*b* are represented by a reference sign 711 in FIG. 4A. Similarly, alignment plates 710*a* and 710*b* are arranged on the stack tray 700. The alignment plates 710*a* and 710*b* are used to align sheets discharged onto the stack tray 700 in the sheet width direction. The alignment plates 710*a* and 710*b*, which are represented by a reference sign 710 in FIG. 4A, can be moved in the sheet width direction respectively by later-described lower tray alignment motors M11 and M12 (FIG. 5). In FIG. 4A, the alignment plates 710*a* and 710*b* are arranged respectively in the front and the back. On the other hand, the alignment plates 711*a* and 711*b* are similarly driven respectively by later-described upper tray alignment motors M9 and M10 (FIG. 5). In FIG. 4A, the alignment plates 711*a* and 711*b* are arranged respectively in the front and the back. Furthermore, the alignment plates 710 and 711 are moved up and down respectively by an alignment plate elevator motor M13 for an upper tray (FIG. 5) and an alignment plate elevator motor M14 for a lower tray (FIG. 5), which will be described later. For example, the alignment plates 710 and 711 are moved up and down about an alignment plate axis 713 between aligning positions where they actually execute an alignment process (FIG. 6A) and waiting positions where they wait (FIG. 6B).

The stack trays 700 and 701 can be raised and lowered by later-described tray elevator motors M15 and M16 (FIG. 5). The topmost surface of a tray or sheets on a tray is detected by later-described sheet surface detecting sensors 720 and 721 (FIG. 4A). The finisher 500 performs control so that this topmost surface of a tray or sheets on a tray is always located at a certain position by driving and rotating the tray elevator motors M15 and M16 in accordance with the input from the sheet surface detecting sensors 720 and 721. Furthermore, paper presence/absence sensors 730 and 731 (FIG. 4A) detect whether or not there is any sheet on the stack trays 701 and 700.

<Finisher Control Unit>

A description is now given of a configuration of the finisher control unit 951 that controls driving of the finisher 500 with reference to FIG. 5. FIG. 5 is a block diagram showing a configuration of the finisher control unit 951 according to an embodiment.

The finisher control unit 951 includes a CPU 952, a ROM 953, a storage unit 954, and the like. The finisher control unit 951 controls driving of the finisher 500 by communicating with the CPU circuit unit 900 so as to perform exchange of data such as transmission/reception of commands, exchange of job information, and notification of sheet transfer, and executing various types of programs stored in the ROM 953. The following describes various types of inputs and outputs of the finisher 500.

In order to convey sheets, the finisher 500 includes an entrance motor M1 that drives and rotates the pairs of conveyance rollers 511 to 513, a buffer motor M2, a discharge motor M3, a shift motor M5, solenoids SL1 and SL2, and conveyance sensors 570 to 576. The finisher 500 also includes, as means to drive various types of members in the process tray 630 (FIG. 4A), a bundle discharge motor M4 that drives the pair of bundle discharge rollers 680, and alignment motors M6 and M7 that drive alignment members 641 (FIG. 4A). The finisher 500 further includes a swing guide motor M8 that drives a swing guide to be raised and lowered. The finisher 500 further includes tray elevator motors M15 and M16 for raising and lowering the stack trays 700 and 701, sheet surface detecting sensors 720 and 721 (FIG. 4A), and paper presence/absence sensors 730 and 731. In relation to alignment operations for sheets on the stack trays, the finisher 500 further includes upper tray alignment motors M9 and M10, lower tray alignment motors M11 and M12, an alignment plate elevator motor M13 for the upper tray, and an alignment plate elevator motor M14 for the lower tray.

<Sort Operations>

Figure 10A:
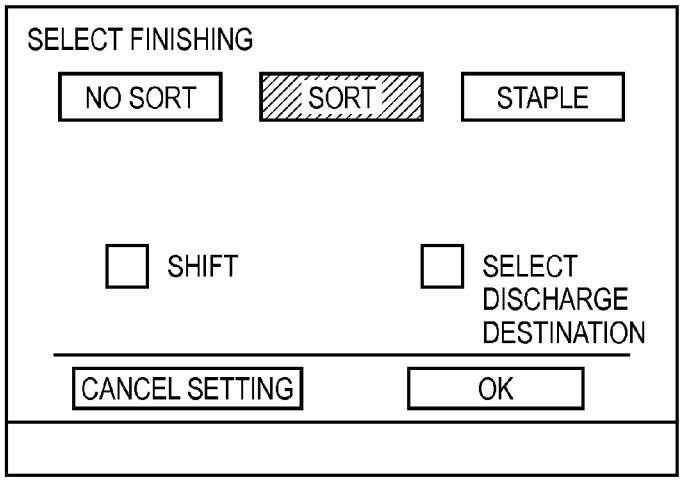
FIGS. 10A to 10C show a finishing mode selection screen according to embodiments.
Figure 10B:
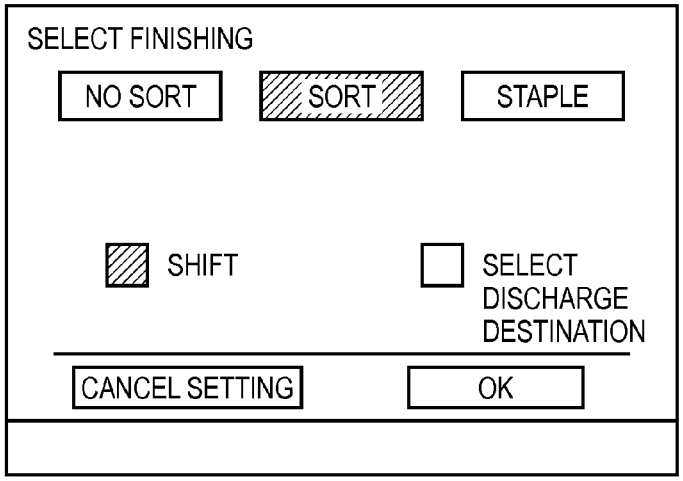
Figure 10C:
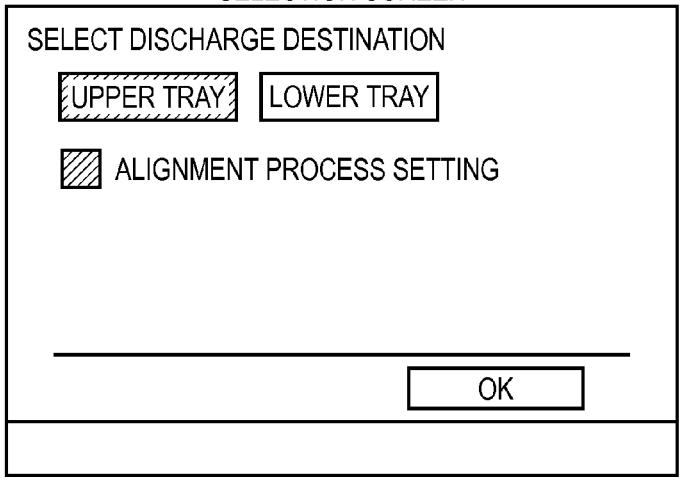
Figure 11:
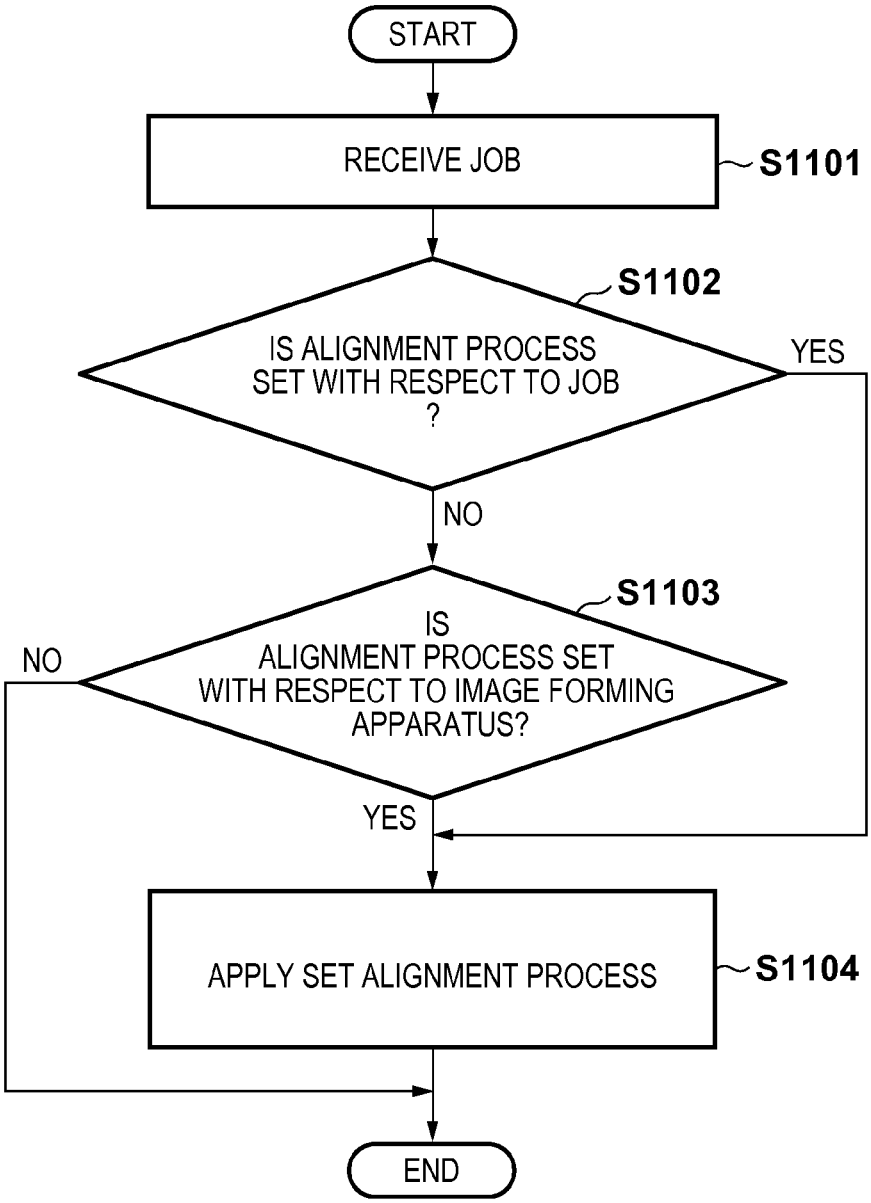
FIG. 11 is a flowchart of processing for applying an alignment process setting according to a first embodiment.

The following describes a flow of sheets during a sort mode with reference to FIGS. 3, 7, 8A to 8D, 10A to 10C, and 11. When the user presses a "Select Sheet" key 418 on the default screen shown in FIG. 3 on the operation display unit 400 of the image forming apparatus 10, a sheet feeding tray selection screen shown in FIG. 11 is displayed on the display unit 420. On this sheet feeding tray selection screen, the user selects sheets to be used for a job. It is assumed here that the user selects the size "A4" corresponding to a sheet feeding tray 1. FIG. 11 shows one example of the sheet feeding tray selection screen on which the size "A4" is selected.

When the user selects the "Finish" software key 417 on the default screen shown in FIG. 3 on the operation display unit 400 of the image forming apparatus 10, a finish menu selection screen shown in FIG. 10A is displayed on the display unit 420. When the user presses an OK button while a "Sort" key is selected on the finish menu selection screen shown in FIG. 10A, the sort mode is set.

In order to offset a bundle of sheets on a per-copy basis, the user presses the OK button while a "Shift" key is selected on the finish menu selection screen shown in FIG. 10A; as a result, a shift mode is set.

Once the user has designated the sort mode and entered a job, the CPU 901 in the CPU circuit unit 900 notifies the CPU 952 in the finisher control unit 951 of information related to that job, such as the sheet size and the selection of the sort mode. In the present embodiment, after sheets have been discharged in one print job, shift operations are applied to sheets printed in the next print job so that the sheets printed in the next print job are discharged at a different position from the sheets discharged in the previous job. Such shift operations applied for each print job are referred to as an inter-job shift.

Figure 7:
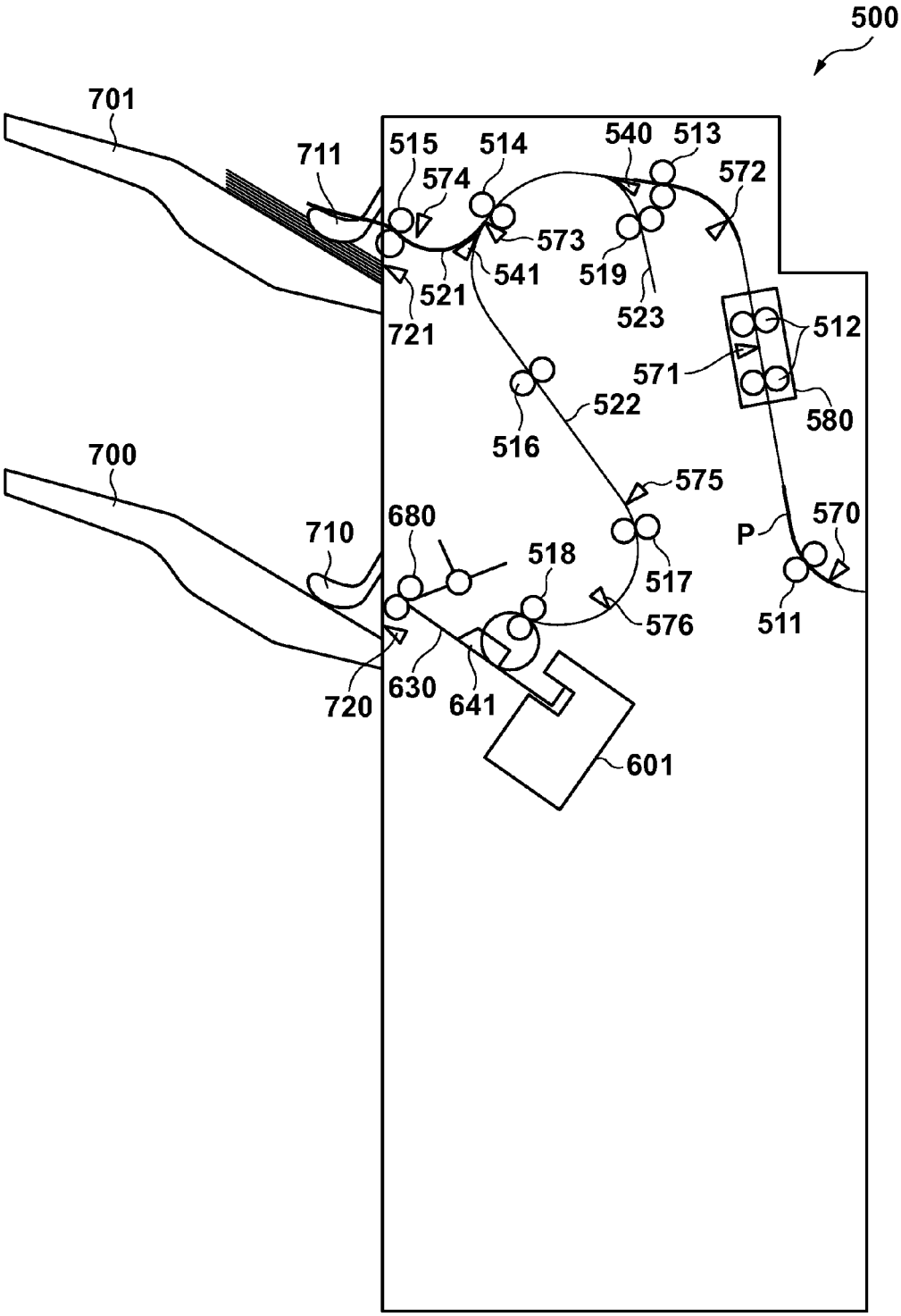
FIG. 7 is a diagram for describing the conveyance of sheets in the finisher according to embodiments.

FIG. 7 is a diagram for describing the conveyance of sheets in the finisher according to an embodiment, and in FIG. 7, the parts that are shown in the above-described FIG. 4A are given the same reference signs thereas.

When the image forming apparatus 10 discharges a sheet P to the finisher 500, the CPU 901 in the CPU circuit unit 900 notifies the CPU 952 in the finisher control unit 951 of the start of sheet transfer. The CPU 901 also notifies the CPU 952 in the finisher control unit 951 of sheet information, such as shift information and sheet width information of the sheet P. Upon receiving the notification of the start of sheet transfer, the CPU 952 drives and rotates the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. The conveyance sensor 571 detects the sheet P when the pair of conveyance rollers 512 holds the sheet P therebetween. Accordingly, the CPU 952 offsets the sheet P in the width direction by moving the shift unit 580 through driving of the shift motor M5. When the shift information included in the sheet information notified from the CPU 901 shows "no shift designation", sheets are equally offset by 15 mm toward the front.

When the switching flapper 541 is driven and rotated by the solenoid SL1 to be situated in the position shown in FIG. 7, the sheet P is directed to the upper discharge path 521. Then, when the conveyance sensor 574 detects passing of the trailing edge of the sheet P, the CPU 952 discharges the sheet P onto the stack tray 701 by driving and rotating the discharge motor M3 so that the sheet P is conveyed by the pair of conveyance rollers 515 at a speed suited for stacking.

Next, a description is given of the alignment operations during a sort mode, using an example of the front shift operations, with reference to FIGS. 8A to 8D. FIGS. 8A to 8D are diagrams for describing the positions of the alignment plates 711*a* and 711*b* on the stack tray 701 as viewed in a direction opposing the sheet discharge direction.

Figure 8A:
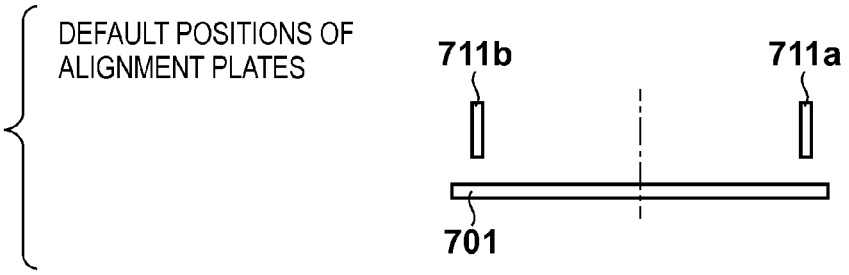
FIGS. 8A to 8D are diagrams for describing alignment operations for sheets on a discharge tray during a sort mode according to embodiments.
Figure 8B:
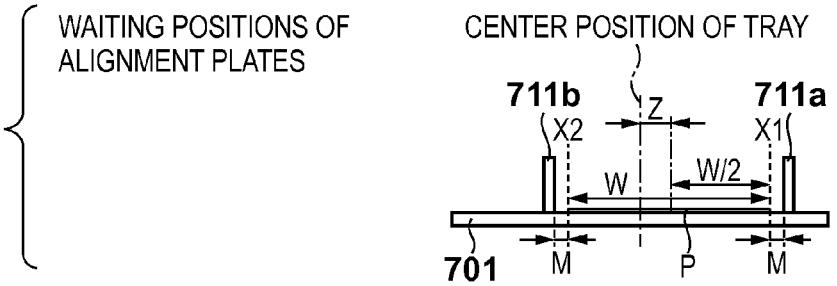
Figure 8C:
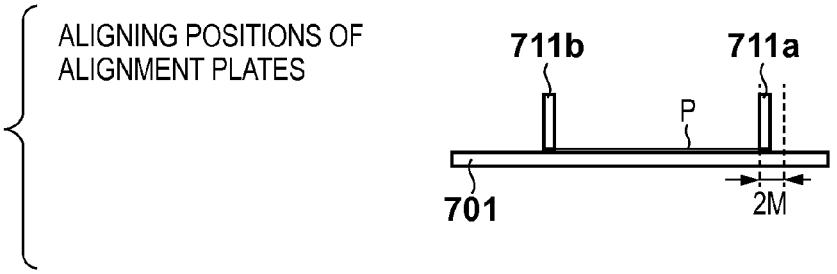
Figure 8D:
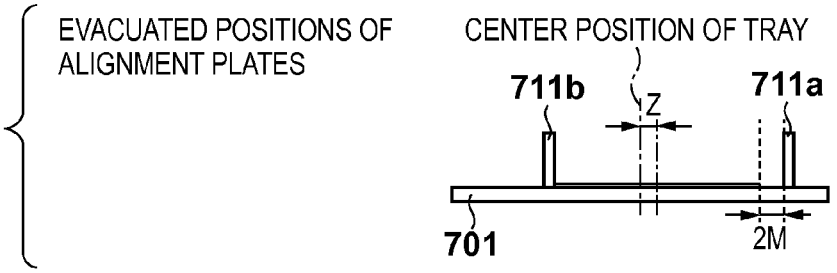

As shown in FIG. 8A, before a job is started, the pair of alignment plates 711*a* and 711*b* waits at default positions. As shown in FIG. 8B, when the job is started, the front alignment plate 711*a* moves to an alignment waiting position that is distant from a front sheet edge position X1 by a predetermined retracted amount M. Note, the front sheet edge position X1 is distant from the center position of the stack tray 701 by a distance obtained by adding a shift amount Z to W/2 which is half of the sheet width. The alignment plate 711*a* waits at this alignment waiting position until a sheet is discharged. On the other hand, the back alignment plate 711*b* waits at an alignment waiting position that is distant from a back sheet edge position X2 by the predetermined retracted amount M. Note, the back sheet edge position X2 is distant from the center position of the stack tray 701 by a distance obtained by subtracting the shift amount Z from W/2 which is half of the sheet width. When a predetermined time period has elapsed since the sheet P was discharged onto the stack tray 701, the front alignment plate 711*a* moves toward the center of the stack tray 701 by a predetermined push amount 2M so as to press the sheet P against the stopped back alignment plate 711*b* as shown in FIG. 8C. As a result, the sheet P is moved toward the alignment plate 711*b* by the retracted amount M. When a predetermined period has elapsed since the sheet P was pressed against the alignment plate 711*b* in the above manner, the alignment plate 711*a* is retracted to the alignment waiting position as shown in FIG. 8D. More specifically, the alignment plate 711*a* is retracted away from the sheet P in the sheet width direction by 2M which is twice the retracted amount M, then waits until the next sheet is discharged onto the stack tray 701. Provided that the offset value Z is 15 mm and the retracted amount M is 5 mm, the front alignment plate 711*a* pushes the sheet P by 5 mm during the alignment operations, and therefore the offset value of the sheet P after the alignment operations is 10 mm. By repeating the above operations, a sheet P is aligned each time it is discharged onto the stack tray 701.

<Shift-Sort Operations>

The following describes a flow of sheets during a shift-sort mode with reference to FIGS. 3, 7, 9A to 9G, and 10A to 10C. The shift-sort mode is set when the OK key is pressed while the "Sort" and "Shift" keys are selected on the finish menu selection screen shown in FIG. 10B.

Once the user has designated the shift-sort mode and entered a job, the CPU 901 in the CPU circuit unit 900 notifies the CPU 952 in the finisher control unit 951 of the selection of the shift-sort mode, similarly to the case of a no sort mode. The following describes the operations for a shift-sort mode in the case where one "copy" is composed of three sheets.

When the image forming apparatus 10 discharges a sheet P to the finisher 500, the CPU 901 in the CPU circuit unit 900 notifies the CPU 952 in the finisher control unit 951 of the start of sheet transfer. Upon receiving the notification of the start of sheet transfer, the CPU 952 drives the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. When the conveyance sensor 571 detects that the sheet P is held between the pair of conveyance rollers 512, the CPU 952 offsets the sheet P by moving the shift unit 580 through driving of the shift motor M5. The sheet P is offset by 15 mm toward the front when the shift information of the sheet P notified from the CPU 901 shows "front", and by 15 mm toward the back when the shift information of the sheet P notified from the CPU 901 shows "back".

The switching flapper 541 is driven and rotated by the solenoid SL1 to be situated in the position shown in the figures, and the sheet P is directed to the upper discharge path 521. When the conveyance sensor 574 detects passing of the trailing edge of the sheet P, the CPU 952 discharges the sheet P onto the stack tray 701 by driving the discharge motor M3 so that the pair of conveyance rollers 515 is rotated at a speed suited for stacking.

Figure 9A:
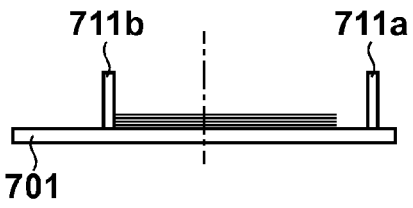
FIGS. 9A to 9G are diagrams for describing alignment operations for sheets on the discharge tray during a shift-sort mode according to embodiments.
Figure 9B:
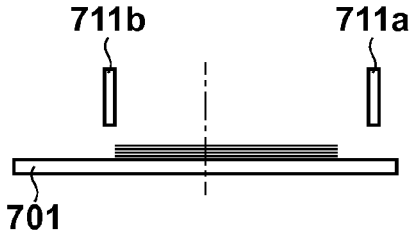
Figure 9C:
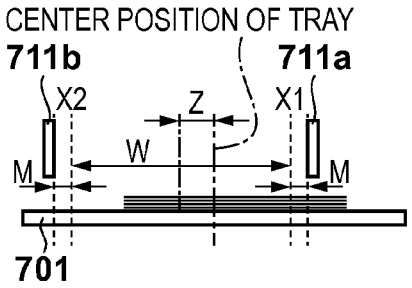
Figure 9D:
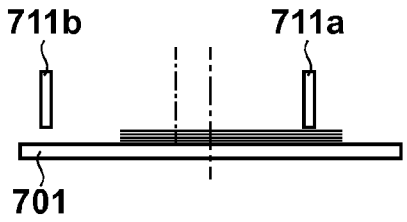

The following describes the operations of the alignment plates at the time of the shifting, using the exemplary case where the shift direction is changed from the front to the back, with reference to FIGS. 9A to 9G. FIGS. 9A to 9G show the stack tray 701 as viewed in a direction opposing the sheet discharge direction. When a retracting operation of the front alignment plate 711*a* is finished as shown in FIG. 9A, the alignment plates 711*a* and 711*b* are raised off the stack tray 701 by a predetermined amount as shown in FIG. 9B. Next, the alignment plates 711*a* and 711*b* move in the sheet width direction to their respective alignment waiting positions for the next sheet. As shown in FIG. 9C, the front alignment plate 711*a* moves to an alignment waiting position that is distant from the front sheet edge position X1 by the predetermined retracted amount M. Note, the front sheet edge position X1 is distant from the center position of the stack tray 701 by a distance obtained by subtracting the shift amount Z from W/2 which is half of the sheet width. The back alignment plate 711*b* moves to an alignment waiting position that is distant from the back sheet edge position X2 by the predetermined retracted amount M. Note, the back sheet edge position X2 is distant from the center position of the stack tray 701 by a distance obtained by adding the shift amount Z to W/2 which is half of the sheet width. Once the alignment plates 711*a* and 711*b* have moved to their respective alignment waiting positions, the alignment plates 711*a* and 711*b* move toward the stack tray 701 by a predetermined amount and wait until the next sheet is discharged onto the stack tray 701 as shown in FIG. 9D. At this time, the alignment plate 711*a* is in contact with the top surface of the already-stacked sheets.

Figure 9E:
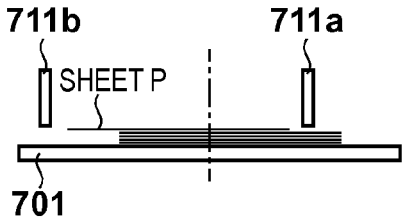
Figure 9F:
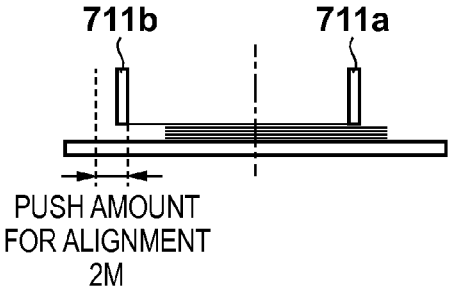
Figure 9G:
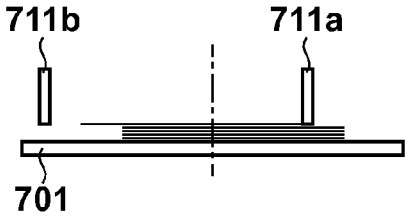

When a predetermined time period has elapsed since a sheet P was discharged onto the stack tray 701 as shown in FIG. 9E, the alignment plate 711*b* moves toward the center of the stack tray 701 by the predetermined push amount 2M so as to press the sheet P against the alignment plate 711*a* as shown in FIG. 9F. When a predetermined time period has elapsed in the state of FIG. 9F, the alignment plate 711*b* is retracted away from the center of the stack tray 701 by the predetermined push amount 2M and waits until the next sheet is discharged onto the stack tray 701 as shown in FIG. 9G.

As described above, when the shift direction is changed, alignment plates are first raised off a stack tray in the upward direction, then lowered after changing the aligning positions; in this way, a sheet is aligned each time it is discharged onto the stack tray.

<Selection of Stack Tray (Discharge Tray)>

When a "Select Discharge Destination" key is selected on the finish menu selection screen shown in FIG. 10A, a discharge destination selection screen shown in FIG. 10C is displayed on the display unit 420. When the user selects a discharge destination and presses the OK key, the discharge destination is selected, and the finishing menu selection screen shown in FIG. 10A is displayed on the display unit 420.

First Embodiment

The following describes a first embodiment of the present invention with reference to FIGS. 11 to 15B. First, with reference to FIG. 11, a description is given of a procedure of processing for the case where an alignment process setting is applied based on the setting for a job or the setting for the image forming apparatus 10. This flowchart is realized by the CPU circuit unit 900 executing the same in accordance with a program stored in the ROM 902.

In step S1101, the CPU circuit unit 900 receives a print job from outside via the external I/F 904 and the image signal control unit 922. Subsequently, in step S1102, the CPU circuit unit 900 determines whether or not the alignment process has been set with respect to the received job (any of ON, OFF, and automatic). If the CPU circuit unit 900 determines that some sort of alignment process setting has been made with respect to the received job, it proceeds to the process of step S1104; on the other hand, if the CPU circuit unit 900 determines that the alignment process setting has not been made with respect to the received job, it proceeds to the process of step S1103.

In step S1103, the CPU circuit unit 900 determines whether or not the alignment process setting that has been set via the operation display controller 941 with respect to the image forming apparatus 10 is ON. If the alignment process setting with respect to the image forming apparatus 10 is ON, the processing moves to step S1104. In step S1104, the image signal control unit 922 notifies the printer control unit 931 of the ON or OFF setting of the alignment process, and ends the processing.

If the printer control unit 931 is notified of the ON setting of the alignment process, it aligns printed materials, which are discharged as a result of executing the job, using the alignment plates (711*a* and 711*b*, or 710*a* and 710*b*). On the other hand, if the alignment process is set to OFF, the printed materials, which are discharged as a result of executing the job, are not aligned using the alignment plates.

In this way, a user can designate whether or not to align printed materials, which are discharged as a result of executing a job, on a per-job basis. Even if the setting is such that the alignment process is not applied to a job, control can be performed to execute the alignment process in the case where the alignment process is set to ON for the image forming apparatus 10.

Although the present embodiment has described the example in which the setting for the image forming apparatus 10 is taken into consideration in step S1103, the processes of step S1103 and step S1104 may not be executed if the alignment process is not set with respect to the job in step S1102. In this way, regardless of the setting for the image forming apparatus 10, the user can decide whether or not to execute the alignment process on a per-job basis in accordance with the ON/OFF setting of the alignment process with respect to each job.

Second Embodiment

Figure 12:
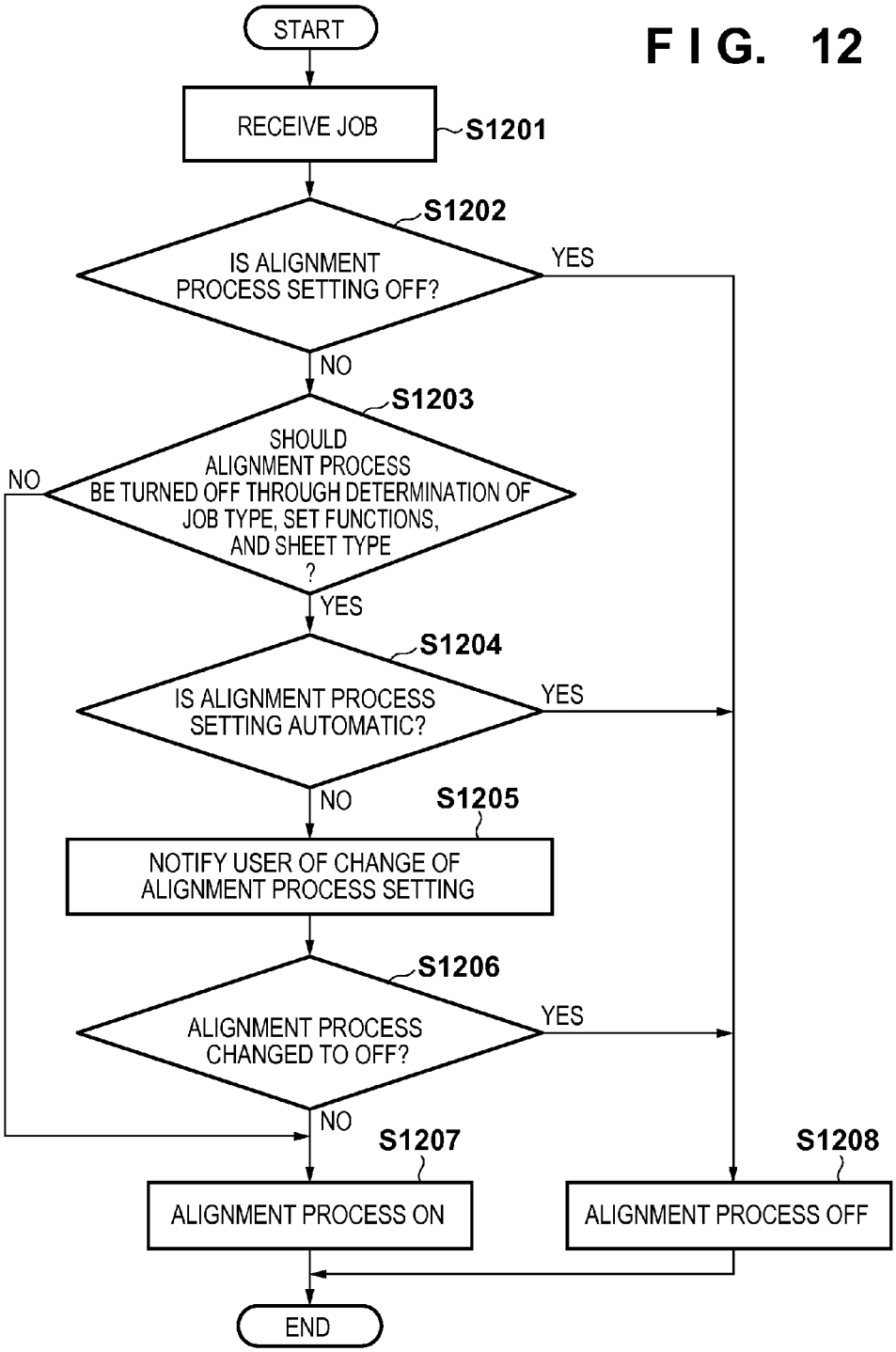
FIG. 12 is a flowchart of processing for determining the application of an alignment process setting and controlling the application according to the first embodiment.

A description is now given of a second embodiment with reference to FIG. 12. FIG. 12 shows a procedure of a processing sequence, from a process in which the CPU circuit unit 900 receives a print job from outside via the external I/F 904 and the image signal control unit 922, to a process in which a print instruction is issued to the printer control unit 931 after the job is analyzed. This flowchart is realized by the CPU circuit unit 900 executing the same in accordance with a program stored in the ROM 902.

In step S1201, the CPU circuit unit 900 receives a print job from outside via the external I/F 904. In step S1202, the CPU circuit unit 900 determines whether or not the alignment process setting for the received job is OFF. If the alignment process is OFF, the CPU circuit unit 900 moves to the process of step S1209; on the other hand, if the alignment process is other than OFF, the CPU circuit unit 900 moves to the process of step S1203.

If the setting of the alignment process for the received job has been designated via a printer driver, the CPU circuit unit 900 conforms to that setting. On the other hand, if the job has been directly input without designation of the alignment process using a direct queue and the like instead of using the printer driver as shown in FIG. 11, the CPU circuit unit 900 conforms to the setting of the alignment process that has been made for the image forming apparatus 10 itself on the screen shown in FIG. 10C.

In step S1203, the CPU circuit unit 900 determines whether or not any setting is included for which it is desirable to change the alignment process to OFF, based on the type of the received job, the type of a medium used in the received job, and settings for the image forming apparatus 10. That is to say, it determines whether or not the settings for the received job and the settings for the image forming apparatus 10 include any setting that influences the execution of the alignment process. Specifically, the CPU circuit unit 900 determines whether or not any condition is included for which it is appropriate to turn the setting of the alignment process OFF by referencing the settings pre-stored in the ROM 902 for which the alignment process is inappropriate. In other words, the CPU circuit unit 900 determines whether or not there is a setting that matches any of the settings stored in the ROM 902.

Figures 13, 14:
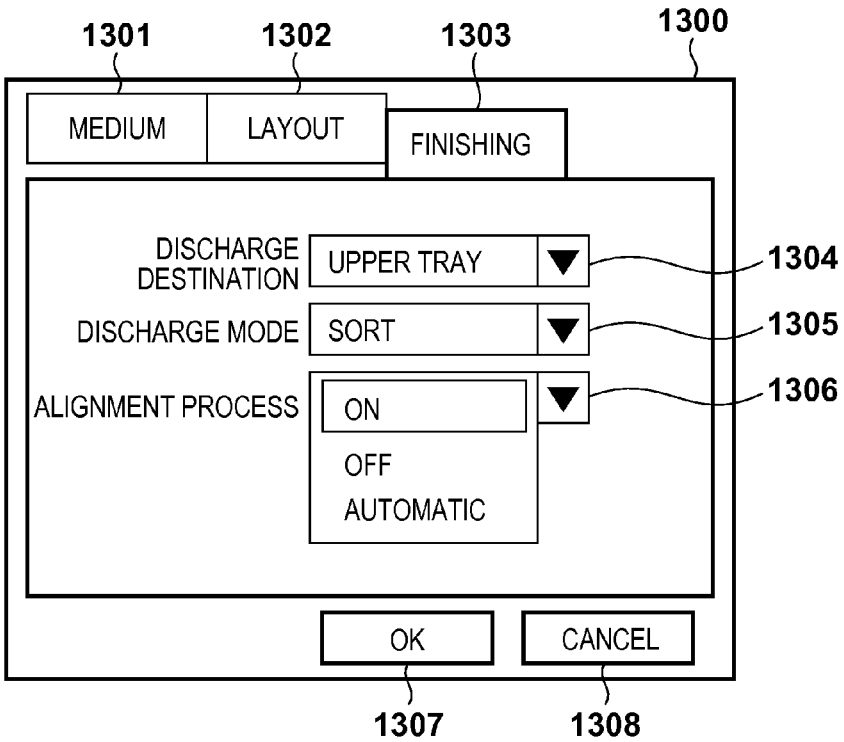
FIG. 13 shows a screen for setting an alignment process on a per-job basis according to the first embodiment.
FIG. 14 shows various types of settings for which the alignment process is inappropriate according to the first embodiment.

FIG. 14 shows examples of the settings pre-stored in the ROM 902 for which the alignment process is inappropriate. As shown in FIG. 14, examples of the settings for which the alignment process is inappropriate include: sample printing and rush printing as job settings; thin papers, coated papers and OHP sheets as medium types; and a silent mode as a setting for the image forming apparatus. That is to say, according to the examples of FIG. 14, it is determined that emphasis is not placed on the alignment process in the case where sample printing and rush printing are set for the job. Sample printing is the setting in which one copy of printed materials (or printed materials of pages that have been designated by the user out of one copy) is test printed before executing the printing of one or more copies set to the job. When executing this sample printing, the user discharges each page for the purpose of picking up one copy of materials that has been printed first and checking each page, and therefore a precise alignment process is not necessary. Therefore, sample printing is registered as a setting for which the alignment process is inappropriate. Rush printing is an interrupt printing function for interrupting a job that is being executed and executing printing in priority to the interrupted job. When executing this rush printing, the user wants to promptly obtain printed materials, and therefore there is a high possibility that speed is required rather than the alignment performance for the printed materials. Therefore, rush printing is registered as a setting for which the alignment process is inappropriate. Furthermore, in the case where coated papers, thin papers, OHP sheets, and the like are used in the image forming apparatus 10, there is a possibility that the front surfaces of the sheets may be subject to friction during the alignment process, and therefore the alignment process may be inappropriate. Moreover, in the case where the image forming apparatus 10 is operating in the silent mode, the operations of the alignment process are turned OFF so as to reduce noise during the alignment operations. During the silent mode, scanners and the like may be turned OFF in addition to the alignment operations. Note that various types of settings shown in FIG. 14, for which the alignment process is inappropriate, may be pre-set by the user or servicemen, and may be brought into conformity with the characteristics of the image forming apparatus 10.

The description of FIG. 12 will now resume. In step S1203, if the received job includes any of the above settings, the CPU circuit unit 900 determines that it is desirable to turn the alignment process OFF. If the received job includes any setting for which it is desirable to turn the alignment process setting OFF, the CPU circuit unit 900 proceeds to the process of step S1204. If the received job does not include such setting, the CPU circuit unit 900 proceeds to the process of step S1207.

Figure 15A:
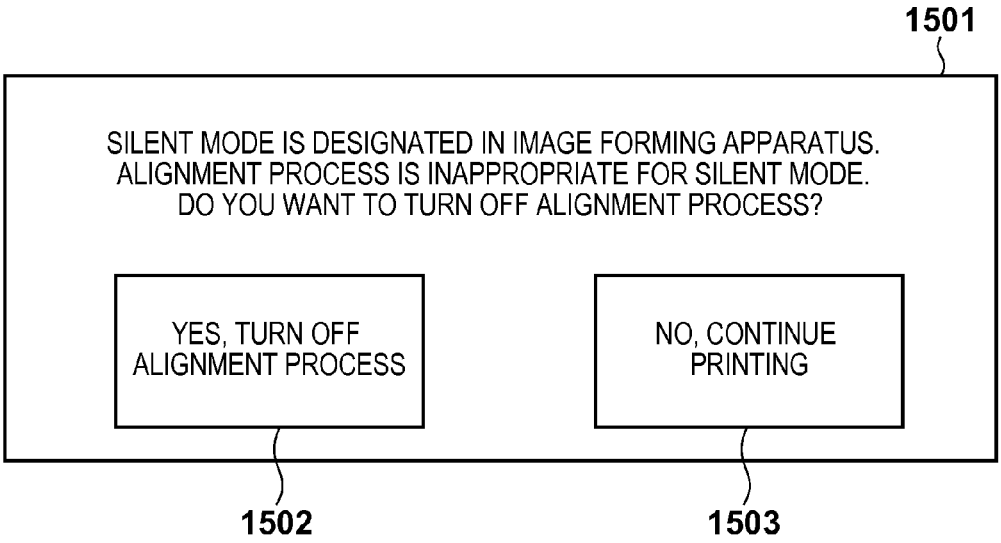
FIGS. 15A and 15B show notification screens for the case where the alignment process is inappropriate according to the first embodiment.
Figure 15B:
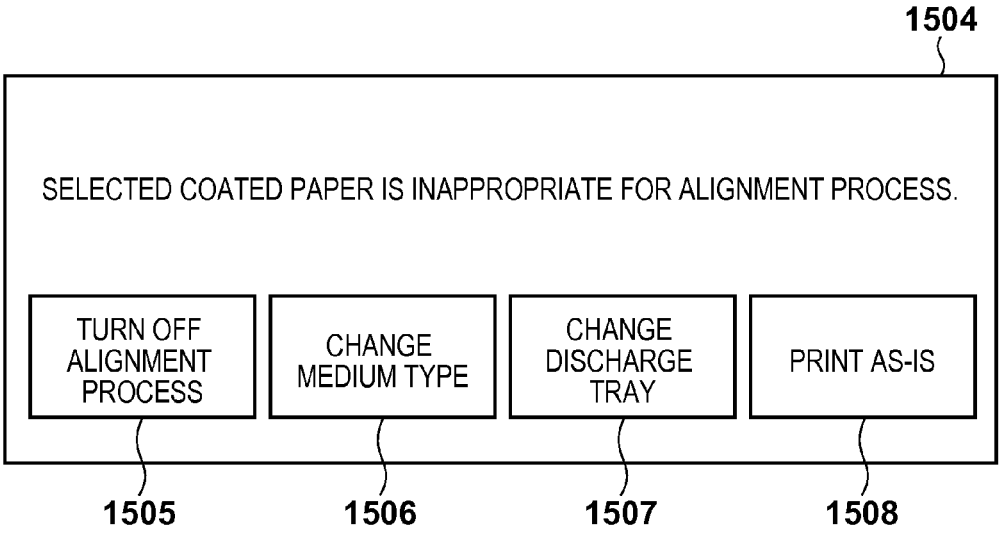

In step S1204, the CPU circuit unit 900 determines whether or not the alignment process setting is automatic. A screen for setting the alignment process to automatic will be described later with reference to FIG. 13. The CPU circuit unit 900 proceeds to the process of step S1208 if it determines that the alignment process is set to automatic, and proceeds to the process of step S1205 if the alignment process is not set to automatic (that is to say, if the alignment process is set to ON). In step S1205, the image signal control unit 922 notifies the user of the inappropriateness of the set alignment process for the job to be printed or the settings for the image forming apparatus 10 via the operation display control unit 941. FIGS. 15A and 15B show examples of such notification via the operation display control unit 941. Thereafter, in step S1206, the CPU circuit unit 900 determines whether or not it has received, from the operation display control unit 941, a change notification (user input) for turning the alignment process setting OFF. If the CPU circuit unit 900 has received the notification for changing the alignment process setting to OFF, it proceeds to the process of step S1208. If the change notification has not been received, the processing moves to step S1207.

In step S1207, the CPU circuit unit 900 sets the alignment process to ON, notifies the printer control unit 931 of this setting, and ends the processing. On the other hand, in step S1208, the CPU circuit unit 900 sets the alignment process to OFF, notifies the printer control unit 931 of this setting, and ends the processing.

If the printer control unit 931 is notified of the ON setting of the alignment process, it aligns printed materials, which are discharged as a result of executing the job, using the alignment plates (711*a* and 711*b*, or 710*a* and 710*b*). On the other hand, if the alignment process is set to OFF, the printed materials, which are discharged as a result of executing the job, are not aligned using the alignment plates.

<Setting Screen>

With reference to FIG. 13, the following describes an example of a user interface via which the user sets finishing of the job upon input of the job. This screen is displayed on a printer driver that is installed by the user in the computer 905. It should be noted, however, that this screen is not limited to being applied to a printer driver installed in a computer, and is applicable commonly to any user interface capable of making print settings for print jobs. For example, this screen may be displayed on the operation display unit 400 of the image forming apparatus 10.

On a screen 1300 shown in FIG. 13, various types of print settings are made for the job via a printer driver. This screen shown in FIG. 13 is set upon input of the job, and exists separately from the setting screens for the image forming apparatus 10 shown in FIGS. 10A to 10C. Mediums of a sheet size and a sheet type used in printing can be selected from a medium setting tab 1301. Impositions used in the job, such as binding settings and double-sided designation, can be set from a layout setting tab 1302. Discharge operations for the job described in the present embodiment can be set from a finishing setting tab 1303.

A discharge destination setting pull-down 1304 designates an output destination tray for the job. A discharge tray onto which the finisher can discharge sheets can be selected from the pull-down. A discharge mode setting pull-down 1305 designates a finishing mode (sort, shift-sort, etc.) in which the finisher can discharge sheets.

An alignment process setting pull-down 1306 selects whether or not to apply the alignment process to the output job (ON, OFF, or automatic). When automatic is selected, ON or OFF of the alignment process is decided on in accordance with other settings for the job and other settings for the image forming apparatus 10. Also, when ON is selected, if the alignment process is inappropriate as shown in FIG. 12 described above, the user is notified of the inappropriateness of the alignment process for the job settings and is assisted in executing appropriate processes. If an OK button 1307 is pressed, the settings made on the screen 1300 are applied to the job and the screen 1300 is closed. On the other hand, if a cancel button 1308 is pressed, the settings made on the screen 1300 are cancelled and the screen 1300 is closed.

<Notification Screens>

With reference to FIGS. 15A and 15B, the following describes examples of the notification screen for assisting the user in changing the alignment process setting in step S1205. FIG. 15A shows a notification screen 1501 that is displayed when the alignment process is set to ON with respect to the job and the silent mode is set for the image forming apparatus 10. On this notification screen 1501, the user can turn the alignment process setting OFF by pressing an alignment process OFF button 1502 so as to continue printing. In this case, the CPU circuit unit 900 notifies the printer control unit 931 of OFF of the alignment process setting, and the printer control unit 931 does not align printed materials, which are discharged as a result of executing the job, using the alignment plates. On the other hand, pressing a print continuation button 1503 enables selection of continuation of printing while leaving the alignment process setting ON. In this case, the CPU circuit unit 900 notifies the printer control unit 931 of ON of the alignment process setting, and the printer control unit 931 aligns printed materials, which are discharged as a result of executing the job, using the alignment plates. The aforementioned setting change notification is displayed when the job includes any of various types of settings shown in FIG. 14 for which the alignment process is inappropriate. Therefore, a similar notification screen is displayed also in the cases of sample printing and rush printing.

FIG. 15B shows an example of a setting change notification screen 1504 for the case where the job includes a medium for which the alignment process is inappropriate in step S1205. In the case where the job includes a medium for which the alignment process is inappropriate, the user can set one of the four options described below. The user can press an alignment process OFF button 1505 to turn the designated alignment process OFF. In this case, the CPU circuit unit 900 notifies the printer control unit 931 of OFF of the alignment process setting, and the printer control unit 931 does not align printed materials, which are discharged as a result of executing the job, using the alignment plates. The user can also press a medium type change button 1506 to change a medium type, more specifically, to change the setting so as to use a medium type that is influenced by the alignment process to a small extent. After changing to the medium type that is influenced by the alignment process to a small extent, the CPU circuit unit 900 notifies the printer control unit 931 of ON of the alignment process setting, and the printer control unit 931 aligns printed materials, which are discharged as a result of executing the job, using the alignment plates. The user can also press a discharge tray change button 1507 to change a discharge tray to which sheets are output, more specifically, to select a discharge tray to which the alignment process is not applied. In this case, the CPU circuit unit 900 notifies the printer control unit 931 of the change of the discharge tray, and the printer control unit 931 discharges printed materials, which are discharged as a result of executing the job, onto the discharge tray to which the alignment process is not applied (on which alignment plates are not provided). The user can also press a continued printing button 1508 so as to ignore the warning and continue printing as-is. In this case, the CPU circuit unit 900 notifies the printer control unit 931 of OFF of the alignment process setting, and the printer control unit 931 does not align printed materials, which are discharged as a result of executing the job, using the alignment plates. In the above manner, according to the present embodiment, a screen is configured in such a manner that at least one of the following is selectable: changing the alignment process to OFF; changing a medium type; changing a discharge tray; and making no change to the settings.

As described above, according to the present embodiment, if a job and the image forming apparatus include any setting for which the alignment process is inappropriate, the setting can be changed as necessary by notifying the user of such inclusion prior to the execution of printing. This enables the user to execute printing in better conformity with the purpose of the user, thereby preventing wasteful output, such as reprinting.

Third Embodiment

A third embodiment will now be described with reference to FIGS. 16A to 17. In the first embodiment and the second embodiment, the setting of the alignment process can be controlled in accordance with the purpose of the user. This leads to coexistence of a job for which the alignment process setting is ON and a job for which the alignment process setting is OFF. In the case where the user sets the alignment process to OFF and outputs a job in accordance with the purpose of the user, it is assumed that the user immediately picks up materials output to a discharge tray. However, if the alignment process is set to ON for an immediately subsequent job, the alignment plates of a sheet stack unit start to operate upon start of the output of the immediately subsequent job; this makes it difficult to pick up the output materials from the discharge tray, and the user may not have enough time to pick up the output materials from the discharge tray. For this reason, the user needs to interrupt the output of the subsequent job so as to remove the output materials stacked on the discharge tray. This results in the issuance of instructions to interrupt and resume the job, hence a decrease in the productivity of printing as a whole. In view of this, the present embodiment describes an example in which a job output interval is extended in accordance with the alignment process settings for consecutive print jobs. Note that the present embodiment may be applied in combination with the above first embodiment.

Figure 16A:
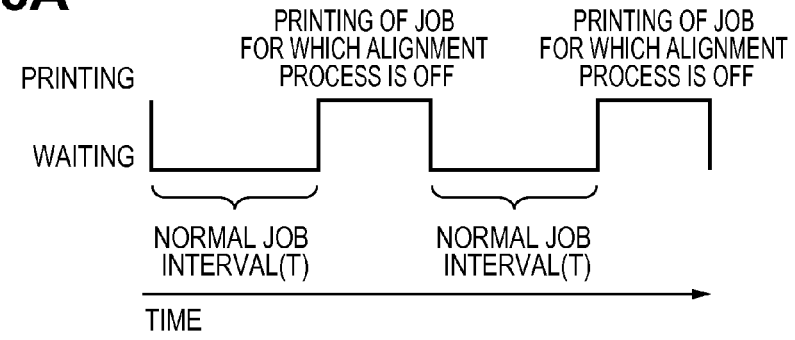
FIGS. 16A to 16D show examples of a job interval according to a third embodiment.

FIG. 16A shows an example of a job interval for the case where jobs for which the alignment process is set to OFF are consecutively output. In the case where jobs for which the alignment process is set to OFF are consecutively output, a normal job interval (T) is applied because the alignment plates do not operate even when the output of a subsequent job is started. As the alignment process is set to OFF consecutively, the user can pick up the discharged output materials at will as necessary.

Figure 16B:
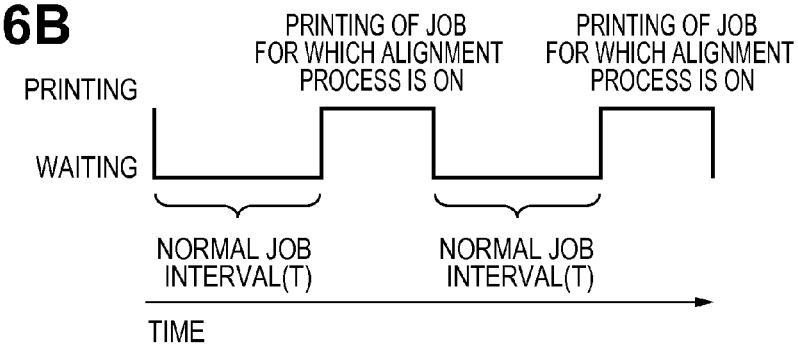

FIG. 16B shows an example of a job interval for the case where jobs for which the alignment process is set to ON are consecutively output. In this example also, a normal job interval (T) is applied. This is because the user is not expected to immediately pick up the output materials.

Figure 16C:
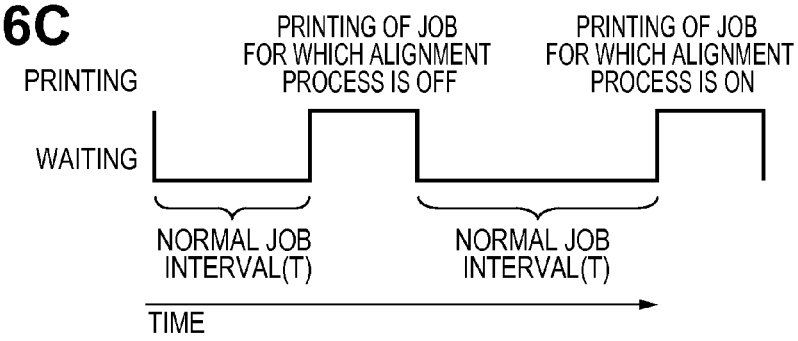

FIG. 16C shows an example of a job interval for the case where a job for which the alignment process is set to OFF is followed by a job for which the alignment process is set to ON. In this case, after the job for which the alignment process is set to OFF, a job interval ((T)+α) that is longer than the normal job interval (T) is applied. By thus extending a job interval as necessary, the user can reliably remove the materials that are output in the job for which the alignment process is set to OFF from a discharge tray, thereby making it unnecessary to interrupt the subsequent job for which the alignment process is set to ON. The aforementioned control of a job interval consequently enables suppression of a significant decrease in the productivity of the image forming apparatus 10.

Figure 16D:
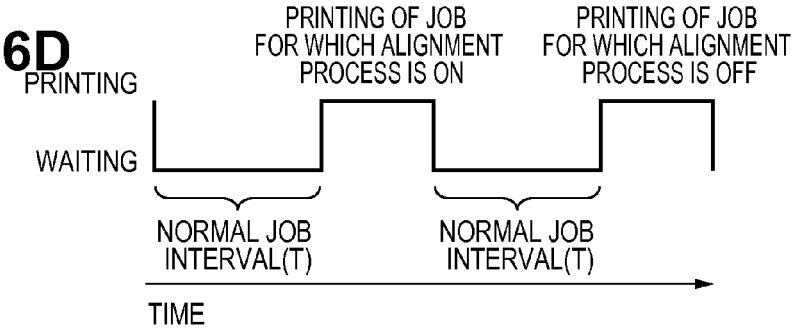

FIG. 16D shows an example of a job interval for the case where a job for which the alignment process is set to ON is followed by a job for which the alignment process is set to OFF. In this case, the user can pick up the materials that are output in the job for which the alignment process is set to ON from the discharge tray as necessary, because the alignment process is set to OFF for the subsequent job; therefore, a normal job interval is applied.

Figure 17:
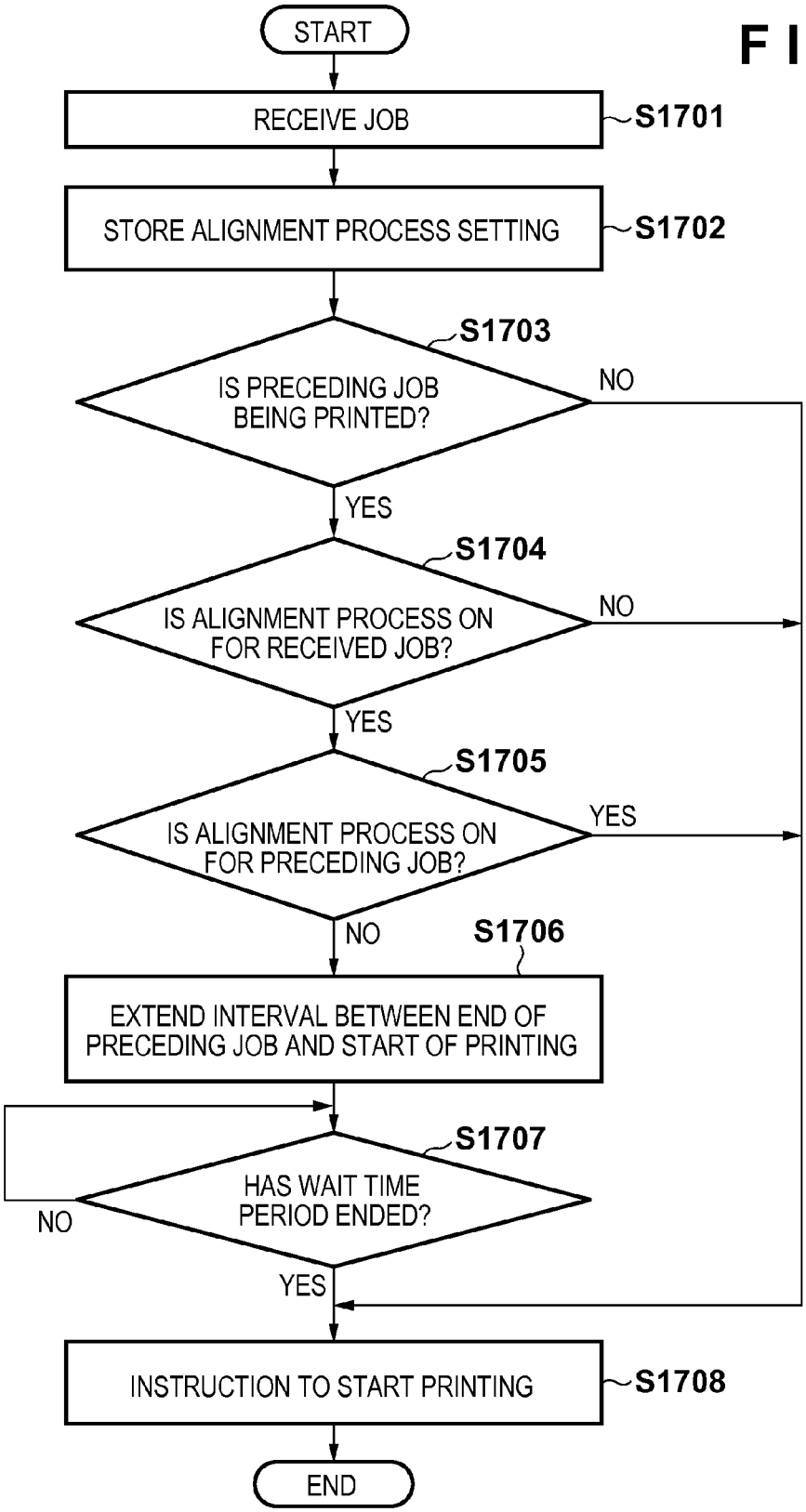
FIG. 17 is a flowchart of processing for changing a job interval according to the third embodiment.

With reference to FIG. 17, the following describes a procedure of processing for controlling the operations for extending a job interval in accordance with a setting for a job to be printed and a setting for an immediately preceding job. This flowchart is realized by the image signal control unit 922 executing the same in accordance with a program stored in the ROM 902.

In step S1701, the CPU circuit unit 900 receives a job from the external I/F 904. Subsequently, in step S1702, the image signal control unit 922 temporarily stores the alignment process setting (ON/OFF) for the received job in the storage unit 903. This information is used in determination associated with control of the next job interval upon input of a subsequent job. Therefore, this information is deleted from the storage unit 903 after the subsequent job has been printed.

Next, the CPU circuit unit 900 determines, upon reception, whether or not the preceding job is being printed by inquiring the printer control unit 931 in step S1703. If the preceding job is still being printed, the CPU circuit unit 900 proceeds to the process of step S1704; on the other hand, if no job is being printed, the CPU circuit unit 900 proceeds to the process of step S1708.

In step S1704, the CPU circuit unit 900 determines whether or not the alignment process is set to ON with respect to the job received in step S1701. If the CPU circuit unit 900 determines that the alignment process is set to ON, it proceeds to step S1705; on the other hand, if the CPU circuit unit 900 determines that the alignment process is set to OFF, it proceeds to step S1708.

In step S1705, based on the information of the preceding job stored in the storage unit 903, the CPU circuit unit 900 determines whether or not the preceding job was output with the alignment process set to ON therefor. If the CPU circuit unit 900 determines that the alignment process was set to ON for the preceding job, it proceeds to the process of step S1707; on the other hand, if the CPU circuit unit 900 determines that the alignment process was set to OFF for the preceding job, it proceeds to the process of step S1706.

In step S1706, the CPU circuit unit 900 extends a job interval by a time period a compared to the normal job interval (T). This time period a to be extended can be changed by servicemen. Subsequently, in step S1707, the CPU circuit unit 900 waits until the elapse of a time period equivalent to the extended job interval, and upon the elapse of that time period, proceeds to the process of step S1708.

In step S1708, the CPU circuit unit 900 instructs the printer control unit 931 to start printing, and ends the processing. By thus extending an interval for starting the printing of a received job in accordance with a setting for a preceding job, the user can easily pick up the output materials from a discharge tray without being influenced by a setting for the subsequent job. For example, according to the present embodiment, in the case where the alignment process is set to OFF for a preceding job and ON for a subsequent job, it is assumed that the user picks up sheets stacked on a discharge tray after the preceding job is finished, and therefore a job interval is extended to allow the user time to pick up the sheets. This is because, if the subsequent job for which the alignment process is ON is started before the user picks up sheets of the preceding job, the user cannot easily pick up the sheets due to the execution of the alignment operations. That is to say, the extension of the job interval allows the user time to pick up the sheets of the preceding job from the discharge tray before the subsequent job is started. This makes it possible to prevent the subsequent job from being interrupted.

Fourth Embodiment

A fourth embodiment will now be described with reference to FIG. 18. The above third embodiment has described the following control with reference to FIG. 17: in the case where a job for which the alignment process is set to ON is printed consecutively after a job for which the alignment process is set to OFF, a time period until the start of printing of the subsequent job is extended. On the other hand, the present embodiment describes control for the case where a sensor is provided that detects the presence and absence of sheets stacked on a discharge tray. Note that the present embodiment may be applied in combination with the above first embodiment.

Figure 18:
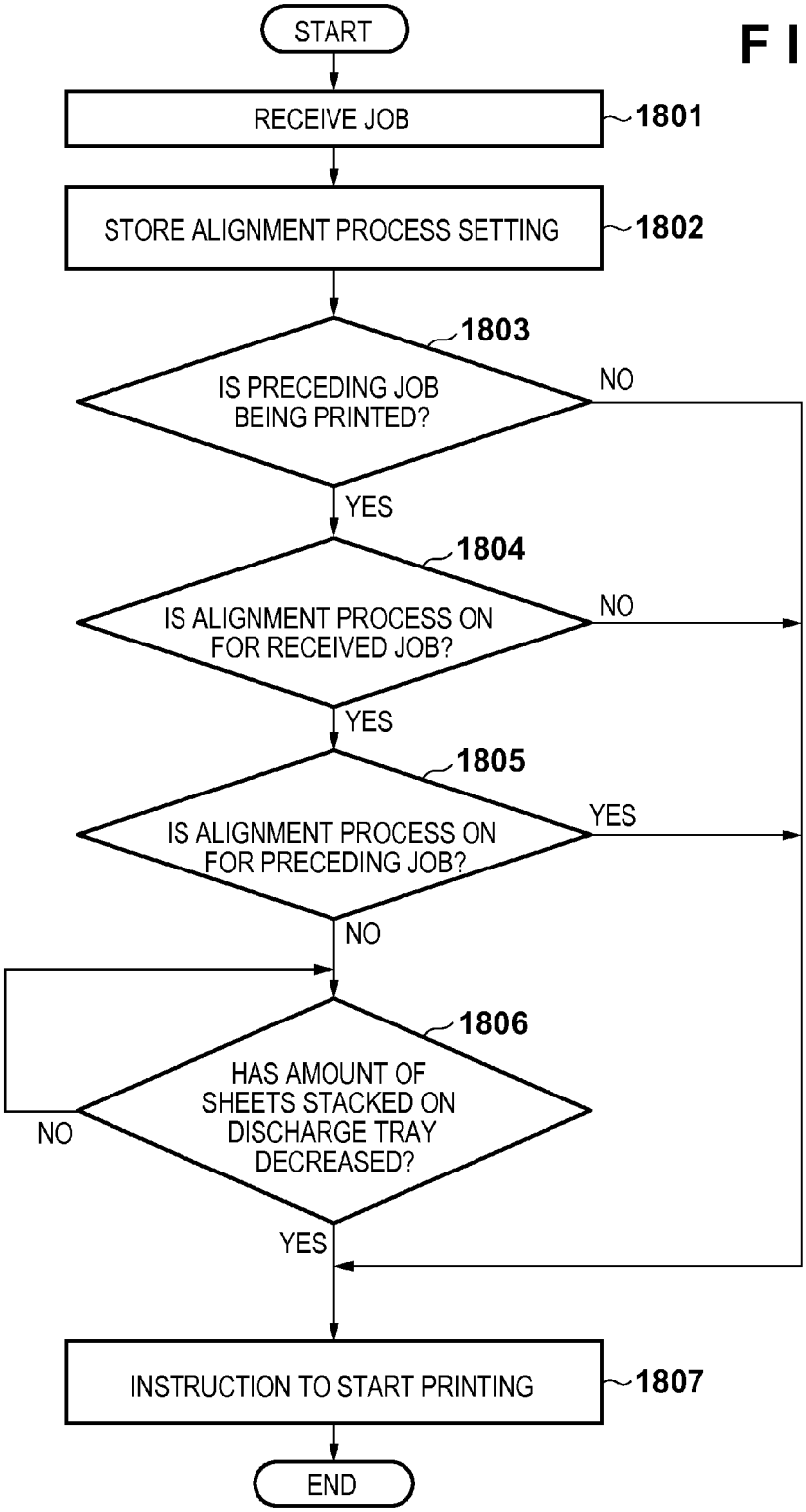
FIG. 18 is a flowchart of processing for changing a job interval according to a fourth embodiment.

With reference to FIG. 18, the following describes a procedure of processing for detecting whether or not sheets on a discharge tray have been removed using a paper presence/absence sensor on the discharge tray in a time period until the start of printing, and for issuing an instruction to start printing of the subsequent job. This flowchart is realized by the CPU circuit unit 900 executing the same in accordance with a program stored in the ROM 902. Note that the processes other than the process of step S1806 are similar to the processes of FIG. 17, and therefore a description thereof is omitted. The process of step S1806 replaces the processes of step S1706 and step S1707 in FIG. 17.

In step S1806, the CPU circuit unit 900 proceeds to the process of step 1807 if it is notified by the finisher control unit 951 of removal of sheets from a discharge tray via the paper presence/absence sensor 730 or 731 provided to the discharge tray. If there is no such notification, the processing returns to step S1806. The paper presence/absence sensors 730 and 731 may be either mechanical sensors or optical sensors, as long as they can detect whether or not sheets stacked on a discharge tray have been removed in the above manner.

According to the present embodiment described above, by issuing an instruction to start printing of a subsequent job for which the alignment process setting is ON using the paper presence/absence sensor 730 or 731, output materials of the subsequent job can be discharged after the user has reliably removed output materials from the discharge tray.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-268805 filed on Dec. 7, 2012, which is hereby incorporated by reference herein in its entirety.

What is claimed is:

1. A sheet processing apparatus comprising:

an alignment unit configured to align sheets stacked on a sheet stack unit;

a receiving unit configured to receive a job for which a user has selected an option among a first option which indicates that an alignment process is to be executed by the alignment unit, a second option which indicates that an alignment process is not to be executed by the alignment unit, and a third option which indicates that whether or not an alignment process is to be executed by the alignment unit is to be judged automatically, the selection being performed on a per-job basis;

a judgment unit configured to judge, based on the user selection for the received job, whether or not the alignment process is to be executed by the alignment unit; and a control unit configured to, in a case where the judgment unit has judged that the alignment process is to be executed by the alignment unit, perform control such that the alignment process is executed, wherein, in a case where the third option is selected, the judgment unit is configured to judge, based on settings for the sheet processing apparatus, whether or not the alignment process is to be executed by the alignment unit.

2. The sheet processing apparatus according to claim 1, wherein in a case where the judgment unit has judged that the alignment process is not to be executed by the alignment unit, the control unit performs control such that the alignment process is not executed.

3. The sheet processing apparatus according to claim 1, further comprising a determination unit configured to determine whether or not other settings for the job include any setting that influences execution of the alignment process, wherein if the judgment unit has judged that the alignment process is set to be executed by the alignment unit, the control unit performs control such that the alignment process is executed if the determination unit has determined that the other settings for the job do not include any setting that influences execution of the alignment process, and even if the judgment unit has judged that the alignment process is set to be executed by the alignment unit, the control unit performs control such that the alignment process is not executed if the determination unit has determined that the other settings include any setting that influences execution of the alignment process.

4. The sheet processing apparatus according to claim 1, further comprising a determination unit configured to determine whether or not other settings for the job include any setting that influences execution of the alignment process, wherein if the judgment unit has judged that the alignment process is set to be executed by the alignment unit, the control unit performs control such that the alignment process is executed if the determination unit has determined that the other settings for the job do not include any setting that influences execution of the alignment process, and even if the judgment unit has judged that the alignment process is set to be executed by the alignment unit, the control unit causes a display unit to display guidance for changing settings of the alignment process if the determination unit has determined that the other settings include any setting that influences execution of the alignment process.

5. The sheet processing apparatus according to claim 3, wherein the determination unit determines whether or not settings for the sheet processing apparatus, in addition to the other settings for the job, include any setting that influences execution of the alignment process.

6. The sheet processing apparatus according to claim 3, wherein even if the judgment unit has judged that the alignment process is set to be executed by the alignment unit, the control unit causes a display unit to perform display that enables a setting for inexecution of the alignment process, or alternatively display for changing a discharge destination, if the determination unit has determined that the other settings include any setting that influences execution of the alignment process.

7. The sheet processing apparatus according to claim 1, wherein the control unit further sets a job interval that is longer than a normal job interval when printing has been executed in a preceding job without execution of the alignment process and printing is to be executed in a subsequent job with execution of the alignment process.

8. The sheet processing apparatus according to claim 1, further comprising a sensor configured to detect a presence or an absence of sheets stacked on a discharge tray, wherein in a case where printing has been executed in a preceding job without execution of the alignment process and printing is to be executed in a subsequent job with execution of the alignment process, the control unit further executes printing in the subsequent job upon detection of removal of sheets of the preceding job in which printing has been executed from the discharge tray using the sensor.

9. A control method for a sheet processing apparatus that includes an alignment unit that aligns sheets stacked on a sheet stack unit, the control method comprising:

receiving a job for which a user has selected an option among a first option which indicates that an alignment process is to be executed by the alignment unit, a second option which indicates that an alignment process is not to be executed by the alignment unit, and a third option which indicates that whether or not an alignment process is to be executed by the alignment unit is to be judged automatically, the selection being performed on a per-job basis;

judging, based on the user selection for the received job, whether or not the alignment process is set to be executed by the alignment unit for the received job; and performing control such that the alignment process is executed in a case where it has been judged that the alignment process is set to be executed by the alignment unit, wherein, in a case where the third option is selected, whether or not the alignment process is to be executed by the alignment unit is judged based on settings for the sheet processing apparatus.

10. A non-transitory computer-readable storage medium storing a computer program for causing a computer to execute a control method for a sheet processing apparatus that includes an alignment unit that aligns sheet stacked on a sheet stack unit, the control method comprising:

receiving a job for which a user has selected an option among a first option which indicates that an alignment process is to be executed by the alignment unit, a second option which indicates that an alignment process is not to be executed by the alignment unit, and a third option which indicates that whether or not an alignment process is to be executed by the alignment unit is to be judged automatically, the selection being performed on a per-job basis;

judging, based on the user selection for the received job, whether or not the alignment process is set to be executed by the alignment unit for the received job; and performing control such that the alignment process is executed in a case where it has been judged that the alignment process is set to be executed by the alignment unit, wherein, in a case where the third option is selected, whether or not the alignment process is to be executed by the alignment unit is judged based on settings for the sheet processing apparatus.

* * * * *